US007618346B2

(12) United States Patent
Crawford et al.

(10) Patent No.: US 7,618,346 B2
(45) Date of Patent: Nov. 17, 2009

(54) SYSTEM AND METHOD FOR CONTROLLING AN EXERCISE APPARATUS

(75) Inventors: Douglas A. Crawford, Lafayette, CO (US); Bradley J. Smith, Tyler, TX (US)

(73) Assignee: Nautilus, Inc., Vancouver, WA (US)

( * ) Notice: Subject to any disclaimer, the term of this patent is extended or adjusted under 35 U.S.C. 154(b) by 747 days.

(21) Appl. No.: 10/789,579

(22) Filed: Feb. 26, 2004

(65) Prior Publication Data

US 2004/0209738 A1 Oct. 21, 2004

Related U.S. Application Data

(60) Provisional application No. 60/450,890, filed on Feb. 28, 2003, provisional application No. 60/450,789, filed on Feb. 28, 2003, provisional application No. 60/451,104, filed on Feb. 28, 2003.

(51) Int. Cl.
*A63B 71/00* (2006.01)
*A63B 22/02* (2006.01)

(52) U.S. Cl. ..... 482/8; 482/51; 482/54

(58) Field of Classification Search ..... 482/51, 482/54, 1–9, 900–902; 119/700; 434/247
See application file for complete search history.

(56) References Cited

U.S. PATENT DOCUMENTS 3,711,812 A 1/1973 Cherry
3,735,101 A 5/1973 Stewart
3,826,491 A 7/1974 Elder
3,848,467 A 11/1974 Flavell
3,870,297 A 3/1975 Elder
4,364,556 A 12/1982 Otte
4,687,195 A 8/1987 Potts
4,708,337 A 11/1987 Shyu
4,708,338 A 11/1987 Potts
4,720,093 A 1/1988 Del Mar
4,749,181 A 6/1988 Pittaway et al.

(Continued)

FOREIGN PATENT DOCUMENTS

CN 2675190 Y 2/2005

(Continued)

OTHER PUBLICATIONS

International Search Report dated Nov. 22, 2004, in corresponding International Application No. PCT/US04/05837.

*Primary Examiner*—Glenn Richman
(74) *Attorney, Agent, or Firm*—Dorsey & Whitney LLP

(57) ABSTRACT

The various embodiments of the present invention generally provide a control system and a process for an exercise apparatus configurable into a combined treadmill and stepper mode. The apparatus may also be configured into stepper only and treadmill only modes. The apparatus generally includes a master control unit, a first sensor, in communication with the master control unit, which generates a first signal indicative of an effective tread speed for the apparatus, and a resistive element that includes at least one resistance level. Using the first signal, the resistance level, and empirical information, the amount of energy expended by a user of the apparatus may be calculated and the operation of the apparatus controlled. Various sensors, actuators and information, such as that obtained from various data structures, may be utilized in performing calculations and controlling the features, functions and operation of the apparatus.

8 Claims, 9 Drawing Sheets

U.S. PATENT DOCUMENTS 4,831,242 A 5/1989 Englehardt et al.
4,842,266 A 6/1989 Sweeney, Sr. et al.
4,913,396 A 4/1990 Dalebout et al.
4,918,266 A 4/1990 Dalebout et al.
4,974,831 A 12/1990 Dunham
4,998,725 A 3/1991 Watterson et al.
5,054,770 A 10/1991 Bull
5,062,626 A 11/1991 Dalebout et al.
5,104,120 A 4/1992 Watterson et al.
5,139,255 A 8/1992 Sollami
5,149,084 A 9/1992 Dalebout et al.
5,162,029 A 11/1992 Gerard
5,171,196 A 12/1992 Lynch
5,192,255 A 3/1993 Dalebout et al.
5,207,621 A 5/1993 Koch et al.
5,318,490 A 6/1994 Henderson et al.
5,328,427 A 7/1994 Sleamaker
5,336,146 A 8/1994 Piaget et al.
5,365,934 A 11/1994 Leon et al.
5,403,252 A 4/1995 Leon et al.
RE34,959 E 5/1995 Potts
5,431,612 A 7/1995 Holden
5,433,679 A 7/1995 Szymczak et al.
5,462,504 A 10/1995 Trulaske et al.
5,484,362 A 1/1996 Skowronski et al.
5,489,249 A 2/1996 Brewer et al.
5,489,250 A 2/1996 Densmore et al.
5,545,112 A 8/1996 Densmore et al.
5,626,539 A 5/1997 Piaget et al.
5,645,509 A 7/1997 Brewer et al.
5,650,709 A 7/1997 Rotunda et al.
5,669,856 A 9/1997 Liu
5,709,632 A 1/1998 Socwell
5,747,955 A 5/1998 Rotunda et al.
5,752,897 A 5/1998 Skowronski et al.
5,792,029 A 8/1998 Gordon
5,800,314 A 9/1998 Sakakibara et al.
5,803,874 A 9/1998 Wilkinson
5,879,270 A 3/1999 Huish et al.
5,890,997 A 4/1999 Roth
5,993,358 A * 11/1999 Gureghian et al. ..... 482/54
D421,779 S 3/2000 Piaget et al.
6,033,344 A 3/2000 Trulaske et al. ..... 482/7
6,042,513 A * 3/2000 Koteles et al. ..... 482/54
6,042,514 A 3/2000 Abelbeck ..... 482/54
D429,509 S 8/2000 Garza
6,095,951 A 8/2000 Skowronski et al.
6,099,439 A 8/2000 Ryan et al.
6,176,814 B1 1/2001 Ryan et al.
6,283,896 B1 * 9/2001 Grunfeld et al. ..... 482/54
6,312,363 B1 11/2001 Watterson et al. ..... 482/54
6,409,633 B1 * 6/2002 Abelbeck ..... 482/54
6,416,444 B1 7/2002 Lim et al.
6,443,875 B1 9/2002 Golen, Jr. et al.
6,454,679 B1 * 9/2002 Radow ..... 482/4
6,454,682 B1 9/2002 Kuo
6,461,279 B1 10/2002 Kuo
6,626,799 B2 9/2003 Watterson et al.
6,626,803 B1 9/2003 Oglesby et al.
6,645,124 B1 * 11/2003 Clem ..... 482/4
6,676,569 B1 1/2004 Radow
6,730,002 B2 5/2004 Hald et al.
6,783,482 B2 8/2004 Oglesby et al.
6,811,517 B1 11/2004 Eschenbach
6,811,519 B2 11/2004 Kuo
6,893,383 B1 5/2005 Chang et al.
6,902,513 B1 * 6/2005 McClure ..... 482/8
6,918,858 B2 7/2005 Watterson et al.
6,923,746 B1 * 8/2005 Skowronski et al. ..... 482/54
6,997,852 B2 2/2006 Watterson et al.
7,060,008 B2 6/2006 Watterson et al.
7,066,865 B2 6/2006 Radow
7,166,062 B1 * 1/2007 Watterson et al. ..... 482/8
7,179,202 B2 2/2007 Marin et al.
2001/0016542 A1 8/2001 Yoshimura
2004/0147375 A1 7/2004 Stevens
2004/0192514 A1 9/2004 Piaget et al.
2004/0214693 A1 10/2004 Piaget et al.
2005/0043145 A1 2/2005 Anderson et al.
2005/0209052 A1 9/2005 Ashby et al.
2005/0209060 A1 9/2005 Lull
2005/0209061 A1 9/2005 Crawford et al.
2005/0233864 A1 10/2005 Smith et al.

FOREIGN PATENT DOCUMENTS

WO WO 95/16502 A1 6/1995
WO WO 01/58534 A 8/2001

* cited by examiner

SYSTEM AND METHOD FOR CONTROLLING AN EXERCISE APPARATUS

CROSS REFERENCE TO RELATED APPLICATIONS

The present application incorporates by reference, in its entirety, as if fully described herein, and claims priority to the subject matter disclosed in U.S. Provisional Patent Application No. 60/450,890, entitled "System and Method for Controlling an Exercise Apparatus," which was filed on 28 Feb. 2003, U.S. Provisional Patent Application No. 60/450,789 entitled "Dual Deck Exercise Device," which was filed on 28 Feb. 2003, and U.S. Provisional Patent Application No. 60/451,104, entitled "Exercise Device With Treadles," which was filed on 28 Feb. 2003.

The present application also incorporates by reference, in its entirety, as if fully described herein, the subject matter disclosed in:

U.S. patent application Ser. No. 10/789,182, entitled "Dual Deck Exercise Device," which was filed on 26 Feb. 2004, and is further identified by U.S. Postal Service Express Mail Number EV304883463US;

U.S. patent application Ser. No. 10/789,294, entitled "Exercise Device with Treadles," which was filed on 26 Feb. 2004, and is further identified by U.S. Postal Service Express Mail Number EV304883450US;

U.S. Provisional Patent Application No. 60/548,265 entitled "Exercise Device with Treadles" and filed on Feb. 26, 2004; which is further identified by U.S. Express Mail No. EV447 463 280 US;

U.S. Provisional Patent Application No. 60/548,811 entitled "Dual Treadmill Exercise Device Having a Single Rear Roller," and filed on Feb. 26, 2004; which and is further identified by U.S. Express Mail No. EV447 463 293 US;

U.S. Provisional Patent Application No. 60/548,787, entitled "Hydraulic Resistance, Arm Exercise, and Non-Motorized Dual Deck Treadmills," and filed on Feb. 26, 2004; which is further identified by U.S. Express Mail No. EV447 463 302 US; and U.S. Provisional Patent Application No. 60/548,786, entitled "Control System and Method for an Exercise Apparatus," which was filed on 26 Feb. 2004, and is further identified by U.S. Postal Service Express Mail Number EV447463126US.

INVENTIVE FIELD

The inventive field relates to systems and processes for controlling the features, operation and functions of exercise apparatus. More specifically, the inventive field relates to systems and processes for controlling the features, operation and functions of an exercise apparatus which combines walking, running and/or striding type movements (which commonly occur in a horizontal or substantially horizontal direction) and stair climbing, stepping and/or climbing type motions (which commonly occur in a vertical or substantially vertical direction).

BACKGROUND

To date, various exercise apparatus have been developed which facilitate in-door walking, running and/or striding type motions (hereinafter, collectively "striding"), i.e., motions in a horizontal or substantially horizontal direction without requiring the exerciser to actually change their present location. Examples of such devices include, but are not limited to, treadmills, elliptical trainers (which are generally designed to mimic a running motion while reducing the impact of running upon joints and other devices) and other like devices. Further, various exercise apparatus have been developed which facilitate and/or simulate stair climbing, stepping (as in rolling steps), and/or climbing type motions (hereinafter, collectively "stepping"), i.e., motions in a vertical or substantially vertical direction without requiring the exerciser to actually change their vertical position or physical location. Also, to date an exercise apparatus has been developed which combines striding and stepping type motions into a single physical motion.

Further, while various systems and processes have been developed for controlling, for example, the operation of a treadmill (for striding) or a STAIRMASTER (for stepping), to date there is a need for a control system and process for controlling the features and functions of an exercise apparatus which combines substantially horizontal (i.e., striding) type motions with substantially vertical (i.e., stepping) type motions. Additionally, there is a need for a system and process for determining the amount of energy exerted by an exerciser using a combined striding and stepping motion.

SUMMARY

In one embodiment of the present invention, an exercise apparatus comprising, a master control unit, a first sensor, in communication with the master control unit, which generates a first signal indicative of an effective tread speed for the apparatus, and a resistive element that includes at least one resistance level is provided. The exercise apparatus of this embodiment, may also further comprise a data structure containing data indicative of the amount of energy expended for a given resistance level. The master control unit, in such embodiment, may access the data structure and determine the amount of energy expended based upon at least one of the first signal and at least one resistance level.

In another embodiment, the exercise apparatus may further comprise a second sensor, in communication with the master control unit, which generates at least one second signal with each downward movement of a treadle. The master control unit may calculate the amount of energy expended based upon the received first and second signals. Yet, the exercise apparatus may further comprise a data structure containing data indicative of the amount of energy expended for at least one of a given effective tread speed and a given resistance level; and the master control unit may utilize data from the data structure in calculating the amount of energy expended.

In yet another embodiment, the exercise apparatus may include at least one tread, such that the resistive element imparts a first force upon the tread in a substantially vertical direction. The resistive element may also be configured to counteract at least a portion if not all of a second force imparted upon the tread by an exerciser.

Similarly, in another embodiment of the exercise apparatus, the master control unit may be configured to control the effective tread speed for each of the at least one treads in a substantially horizontal direction. A tread control unit may be included in the exercise apparatus. Such tread control unit may be in communication with the master control unit and may control the rotation of at least one tread on the exercise apparatus. Alternatively and/or additionally, the exercise apparatus may be configured such that the master control unit controls the operation of the tread control unit. Such control by the master control unit may be based upon, for example, a first signal, indicative of a tread speed. In some embodiments, the tread control unit may comprise at least one of a D.C. motor and an A.C. motor.

In yet another embodiment of the present invention, the exercise apparatus may be configured such that striding, stepping or combined striding and stepping motions are facilitated by the apparatus. The master control unit may be configured to determine whether striding, stepping and/or combined striding and stepping motions are to be facilitated by the apparatus based upon at least one of a desired effective tread speed and a desired resistance level. Further, at least one of the desired effective tread speed and the desired resistance level may be specified via a user interface. The master control unit may also be configured to determine whether stepping or combined striding and stepping motions are to be facilitated by the apparatus based upon resistance level.

In yet another embodiment, the apparatus may be configured to operate as at least one of a treadmill, a stepper and a combined treadmill and stepper. For stepping mode, the master control unit may be configured to determine the amount of calories expended based upon the second signal when the first sensor provides a null reading. Similarly, for treadmill mode, the master control unit may be configured to determine the amount of energy expended based upon a first or tread speed signal when a step or second signal provides a null reading.

Also, various embodiments of the present invention provide systems for controlling the operation of an exercise device which may be configured to operate as a treadmill, a stepper, or a combined treadmill and stepper. One embodiment of such a system comprises a processor, a first sensor, in communication with the processor, for sensing a substantially horizontal motion by a tread in the exercise device and generating a first signal indicative thereof, a second sensor, in communication with the processor, for sensing a substantially vertical motion by the tread and generating a second signal indicative thereof, and a data storage device, containing in a data structure information useful in determining the amount of energy expended based upon the first signal and/or the second signal. Further, the processor may be configured to control the operation of the exercise device based upon at least one of the first signal and the second signal. The processor may also be configured, upon receiving the first signal over a given time period, to determine an average effective tread speed over the given time period, accesses data from the data structure based upon a resistance level, and based upon the average effective tread speed and the data determines the effort expended over the given time period.

In yet another embodiment of the present invention, an article of manufacture is provided which comprises a computer usable medium having computer readable program code means embodied therein for selecting a mode for an exercise apparatus, the computer readable program code means further comprising a computer readable program code means for selecting a treadmill mode, and a computer readable program code means for selecting a stepper mode. Yet, the computer usable medium may further comprise a computer readable program code means for selecting a combination striding and stepping mode.

In yet another embodiment of the present invention an apparatus is provided. Such apparatus may comprise a computer usable medium having computer readable program code means embodied therein for selecting a mode for the apparatus, comprising at least any two of a computer readable program code means for selecting a treadmill mode, a computer readable program code means for selecting a stepper mode, and a computer readable program code means for selecting a combined treadmill and stepper mode.

In another embodiment of the present invention, a control system for an exercise apparatus may be provided. One embodiment of a control system comprises a master control unit, and a memory device for holding a data structure for access by the master control unit, wherein the data structure contains at least one data element utilized in determining the effort exerted during use of the exercise apparatus, and wherein the exercise apparatus is configurable into a stepper mode and a treadmill mode. In another embodiment, the exercise apparatus may be further configurable into a combined stepper and treadmill mode.

In another embodiment of the present invention, a program memory or storage device accessible by a processor, tangibly embodying a program of instructions executable by the processor to configure an exercise apparatus into one of a plurality of modes may be provided. Such program of instructions may include receiving at least one user input signal and, based upon the received user input signal, selecting from one of many exercise modes supported by the exercise apparatus. The many exercise modes supported by the exercise apparatus may further include a stepper mode and at least one of a treadmill mode and a combined treadmill and stepper mode.

In another embodiment of the present invention, a method of determining the energy expended during use of an exercise device having a combined treadmill and stepper function, wherein the exercise machine includes dual treadle assemblies operating at a number of steps per minute and having respective treads operating at an effective tread speed may be provided. Such method comprises receiving a first value indicative of a specified weight, receiving a second value indicative of a resistance setting on the exercise device, receiving a third value indicative of an effective tread speed for the exercise device, receiving at least one fourth value indicative of $VO_2$ expended by a population of exercisers over a range of resistances for the combined treadmill and stepper functions, and calculating calories burned as a function of the first value, the second value, the third value and the at least one fourth value.

In another embodiment of the present invention, a method of monitoring a workout on an exercise machine configurable for a treadmill workout or for a stepper workout, wherein the exercise machine includes dual treadle assemblies operating at a number of steps per minute during stepper mode and having respective treads operating at an effective tread speed during treadmill mode may be provided. One embodiment of such method comprises: receiving a first value indicative of a weight, receiving a second value indicative of a resistance level for the exercise machine, and selecting either the stepper mode or the treadmill mode as a function of the second value. Further, when treadmill mode is selected, such method may further comprise receiving a first signal indicative of an effective tread speed and calculating calories burned as a function of the first value, the second value, the first signal, and empirical data indicative of $VO_2$ expended by a population of exercisers for the treadmill mode. Also, when a stepper mode is selected, such method may further comprise receiving a second signal indicative of the number of steps per minute accomplished and calculating calories burned as a function of the first value, the second value, the second signal, and empirical data indicative of $VO_2$ expended by a population of exercisers for the stepper mode.

Thus, it is to be appreciated that the present invention may be provided in numerous embodiments of apparatus, systems, devices, articles of manufacture, data structures, processes, methods and otherwise. The following drawing figures and detailed description describe certain embodiments of the present invention, but, the scope of the present invention is not to be construed as being limited by the following figures or detailed description.

BRIEF DESCRIPTION OF THE DRAWING FIGURES

DETAILED DESCRIPTION

The various embodiments of the present invention provide a control system and process for a combination exercise apparatus which simulates a combined striding and a stepping type motion. Such motion may be characterized as being similar to walking or running on a beach, climbing a loose surface and similar motions wherein an exerciser's foot slides partially while stepping. Further, the various embodiments of the present invention provide a control system and process for controlling the exercise apparatus regardless of whether the apparatus is configured to facilitate a combination striding and stepping motion, a striding only motion, a stepping only motion, or some other motion(s). Also, the various embodiments of the present invention, as discussed in greater detail hereinbelow, provides systems and processes for estimating and/or calculating the amount of energy exerted by an exerciser when using the exercise apparatus in a combination striding/stepping mode, a striding only mode and/or a stepping only mode. Other modes, and energy calculations related thereto, may also be calculated by various embodiments of the control systems and processes of the present invention.

As discussed in greater detail in the related applications identified above, the exercise apparatus of the present invention, in at least one embodiment, includes a set of treadles upon which a belt (or tread) rotates so as to facilitate a striding type motion. The treadles are configured to rotate about an axis such that a stepping type motion may also be obtained. The treadles are desirably interdependent, such that as one treadle rises or falls the other treadle falls/rises a corresponding amount of displacement. Such displacement desirably occurs while the treads are rotating about each treadle, so as to provide for a combination striding and stepping motion.

Figure 1:
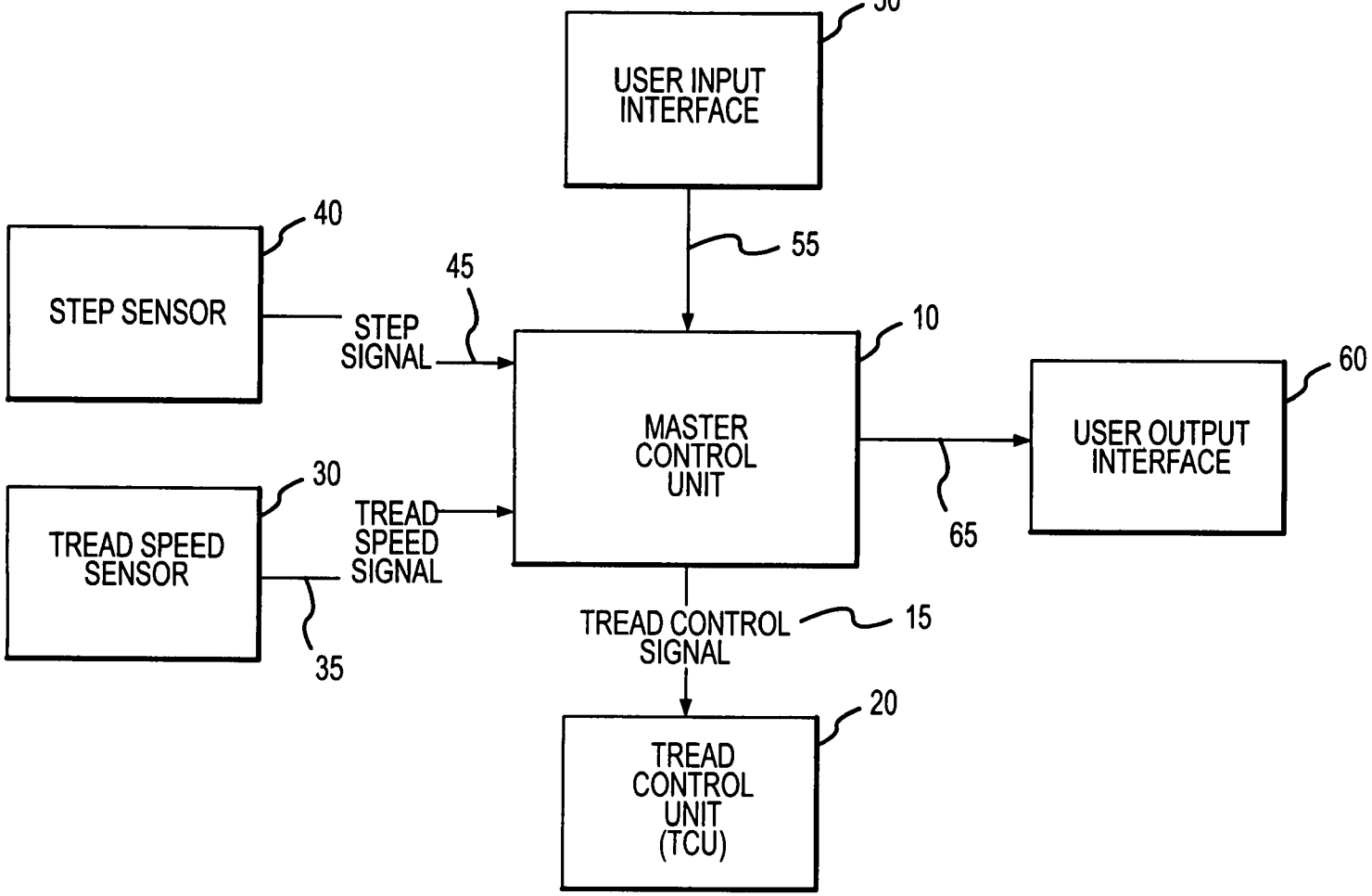
FIG. 1 is a schematic representation of the various sensors, actuators, signals and devices utilized in one embodiment of the control system of the present invention.

The control system and processes of the present invention desirably control the combination striding and stepping motions and calculates the energy expended by an exerciser thereof. To accomplish such control and/or energy calculation features and functions, at least one embodiment of the apparatus of the present invention, as shown in FIG. 1, includes: a Master Control Unit 10 ("MCU"), a Tread Control Unit 20 ("TCU"), a Tread Speed Sensor 30 ("TSS"), a Step Sensor 40 ("SS"), an Exerciser Input Interface 50 ("UII"), and an Exerciser Output Interface 60 ("UOI"), as well as the computer programs and data structures necessary to control and calculate energy expenditures. Each of these components are described in greater detail hereinbelow. It is to be appreciated that various embodiments of the present invention may include all, some, or none of these components.

Control System Overview

At least one embodiment of the present invention includes an MCU 10. The MCU 10 may be utilized to control various aspects of the operation, features and/or functions of the exercise apparatus (hereinafter, the "apparatus"). The MCU provides those output signals necessary to control the operation of the apparatus including, but not limited to, driving the tread belts. The MCU also receives various-input signals which provide status and other operational information.

One output signal the MCU may be configured to generate is shown in FIG. 1, as a tread control signal 15. The tread control signal 15 desirably provides control signals to the "TCU" 20. These control signals may be in a digital signal format, an analog signal format, a combination digital and analog signal format and other formats, should a specific implementation of the present invention so require.

As further shown in FIG. 1, the MCU also is desirably configured, in at least one embodiment of the present invention, to receive a tread speed signal 35 from a TSS. The TSS essentially measures the speed of the treads, such that the effective tread speed, i.e., the speed at which an exerciser walking on the treads would sense and/or the distance an exerciser would travel in a given time period if such exerciser was moving in a substantially horizontal direction over the ground instead of upon the apparatus. The effective tread speed, which may be calculated by the TSS, the MCU and/or other devices, is desirably presented to the exerciser in commonly known and understood measurement figures such as miles per hour, kilometers per hour, feet per minute or the like. Thus, the MCU receives tread speed signals which are utilized in calculating an effective tread speed and other exercise related parameters, for example, energy or watts expended during the exercise routine. The features, functions and various embodiments of the TSS are described in greater detail hereinbelow.

The various embodiments of the apparatus of the present invention may also be configured to include an SS 40. The SS may be configured to provide a Step Signal 45 to the MCU which indicates how often a given tread is raised or lowered and thus, a "step" taken by an exerciser of the apparatus. The features, functions and operation of the SS are described in greater detail hereinbelow.

Referring still to FIG. 1, the various embodiments of the present invention may also include one more UIIs 50 which are in communication with the MCU via communication link 55. In addition to providing input devices by which the exerciser may specify an effective tread speed, the UII may also be configured to include input devices by which the exerciser may input and/or specify various other parameters including, but not limited to, the exerciser's weight, a desired workout setting, a workout time, a desired program routine, and others. Further, the UII may be utilized by the exerciser to control the operation of the apparatus during a "workout," for example, by increasing or decreasing the effective speed of the treads, the angle of the treads, the step resistance, or other parameters. The features, operations and functions of the UII, as provided for in various embodiments of the present invention, are described in greater detail hereinbelow.

The various embodiments of the present invention desirably include one or more OUIs 60 which are in communication with the MCU via communication links 65. The OUI facilitates communication of status, operation, diagnostic and other information (as desired) from the apparatus to the exerciser and/or others (for example, to a coach, trainer, nurse, doctor, technician, computer or others). The features, operations and functions of the OUI, as provided for the various embodiments of the present invention, are described in greater detail hereinbelow.

Master Control Unit ("MCU")

As discussed above, the various embodiments of the present invention commonly include an MCU 10, which controls the features, functions and operation of the apparatus. It is to be appreciated that the MCU may include practically any control unit and/or processor(s) which are configured or may be configured (for example, via software, hard coding or otherwise) to process inputs, generate control signals and provide outputs signals (such as those for presentation or display to an exerciser). Such input, control and/or output signals may include those discussed herein and/or others commonly known and/or used in conjunction with or support of an exercise apparatus.

In at least one embodiment, the MCU includes a control unit which utilizes a processor, such as a digital signal processor, a personal computer processor, a special purpose processor or the like, to process inputs and generate outputs (both display and control). Other processors, such as input/output controllers, display drivers, and other devices may be utilized to support and/or augment the features and functions provided by the MCU.

The MCU also generally includes some form of memory or data storage device or data storage reading device. Examples of memory/storage devices which may be used separately or in conjunction with the apparatus include, but are not limited to, ROM, PROM, EPROM, EEPROM, RAM, DRAM, RDRAM, SDLRAM, EDO DRAM, FRAM, non-volatile memory, Flash memory, magnetic storage devices, optical storage devices, removable storage devices (such as memory sticks and flash memory cards), and the like. The MCU also commonly includes and/or is connected to a power supply. Battery backup may be provided as necessary to preserve exerciser settings and/or other information. The MCU also may be configured to include various types of input and/or output ports. Common examples of such I/O ports ("I/O") include, but are not limited to, serial ports, parallel ports, RJ-11 and RJ-45 interface ports, DIN ports, sockets, universal serial bus ports, "firewire" or IEEE 802.11 ports, wireless interface ports, smart card ports, video ports, PS/2 ports, and the like. One should appreciate that the MCU is not limited to any specific devices and/or system or component configurations, and may be provided, in whole or in part, as a single unit, a plurality of parallel units, remote units (e.g., one provided via an external device, such as a local or remote personal computer), distributed units or in any other configuration capable of supporting the features and functions of the various embodiments of the present invention.

Tread Control Unit ("TCU")

As discussed above, at least one embodiment of the present invention includes a TCU 20 which controls the speed of rotation of the treads on the respective treadles. In one embodiment, the TCU controls the operation of a motor, which drives the treads, by utilizing digital signals from the MCU. Such digital signals may be in any suitable signal format, for example, Pulse Width Modulation ("PWM") signals may be utilized. As is commonly appreciated, PWMs can be utilized to control the operating speed of D.C. motors, and thus the speed of any tread connected directly or indirectly to such motor, by varying the time period during which the D.C. motor is powered. Such time period may be varied by pulsing on/off an input current provided to the motor. PWM may also be utilized to control the rotational speed of the motor by controlling the duty cycle of the motor, i.e., the longer the duty cycle, the longer a drive current is provided, or by modifying the pulse duration of any given duty cycle (i.e., a longer pulse width generally equates to a longer "on" period for the motor). The MCU directly or indirectly, via the TCU, may be configured to control the electricity provided to the motor such that the rotational speed of the motor shaft and the treads connected directly or indirectly thereto are correspondingly controlled. Further, by periodically directing the application of electrical pulses to the motor, via the TCU, the MCU may increase or decrease the rotational speed of the motor shaft which, in turn, results in a corresponding increase or decrease in the speed of the treads. It is to be further appreciated, that the rotational speed of the motor shaft may be slowed and/or stopped by applying a current in an opposite directional flow (which may be a negative or positive current, depending upon the specific implementation utilized) so as to apply a decelerating or braking effect to the motor shaft. In short, the MCU, in at least one embodiment, provides tread control signals to the TCU. Such tread control signals directly or indirectly control the operation of the motor and thereby control the speed and/or direction of the treads.

It is to be appreciated that for certain alternative embodiments, the MCU may be configured to provide, and the TCU configured to receive and act upon, tread control signals which result in the motor rotating the treads in a second or opposite direction, wherein a first tread direction is defined as the direction of travel of the treads away from a console such that as an exerciser faces the console the exerciser effectively walks on the treads and towards the console, and the second tread direction is defined as the direction of travel of the treads towards the console such that as the exerciser faces the console the exerciser effectively walks backwards and away from the console. It is to be appreciated that when the motor is driving the treads in the second tread direction, an exerciser may suitably position themselves such that they are facing 180 degrees away from the console, and as the tread progresses towards the console, the exerciser effectively utilizes a "stepping-up" motion. The location and configuration of the various embodiments of the console for the present invention are described in greater detail in the related applications.

Further, it is commonly appreciated that a given motor generally may operate within a pre-determined range of rotational speeds and that greater or lesser speeds may be obtained using pulleys, belt-drive mechanisms, geared mechanisms, or the like. For purposes of at least one embodiment of the present invention, the apparatus may be suitably configured to provide tread speeds over an operating range of 0.7 miles per hour to 4.0 miles per hour in the first tread direction. Comparable, greater and/or lesser speeds may also be supported in the second tread direction in alternative embodiments. Further, the motor is desirably configured to provide speed increments of 0.1 miles per hour over the specified operating range. However, greater or lesser operating speeds, ranges of speeds, and/or greater or lesser speed increments may be supported in other embodiments as desired. However, the present invention is not to be construed as being limited to apparatus which only operate over any specific range of speeds, or any specific speed.

Tread Speed Sensor ("TSS")

As mentioned above, at least one embodiment of the present invention includes a TSS 30 which is utilized in calculating and/or controlling the effective tread speed. It is to be appreciated that the TSS essentially provides a feedback loop (providing speed measurement signals), to the MCU 10 which enables the MCU, in certain embodiments, to monitor and control the driving of the treads by the TCU. In other embodiments, such as those wherein an A.C. motor or other tread drive mechanism are utilized and from which the effective tread speed may be determined directly or indirectly based upon tread control signals 15 or other signals, the TSS 30 may or may not be utilized. In yet other embodiments, the TSS may be essential to the operation of the device, as the drive mechanism for the treads may not be capable of reliably being calibrated or controlled based upon input signals to a drive mechanism and/or other signals. Thus, it is to be appreciated that the TSS, in certain embodiments, provides signals useful in calculating and controlling an effective tread speed and that such signals may be generated or derived, as necessary, for particular embodiments of the present invention.

More specifically, in at least one embodiment of the present invention, a TSS includes a read switch (hereinafter, the "tread switch") which is configured to detect the passing of a magnet (hereinafter, the "tread magnet") situated on a pulley or other component that is attached directly or indirectly to the motor/drive mechanism. With each corresponding rotation of the pulley and/or the drive shaft (gearing and the like may be utilized), the tread magnet passes the tread switch, which detects the passing of the tread magnet and outputs a tread speed signal 35 to the MCU 10. The MCU receives and utilizes the tread speed signal to calculate the effective speed of the treads.

It is to be appreciated that the effective speed of the treads may be determined based upon measurements obtained from any location on the pulley (or any other drive mechanism component). Correspondingly, it is to be appreciated that greater or lesser degrees of precision may be obtained by positioning the tread magnet and the corresponding tread switch inwards or outwards, respectively, along a radius of the pulley. As such, for purposes of the present embodiment of the invention, the location of the tread magnet upon the pulley is situated on the axis of the pulley such that a given number of rotations of the pulley result in the measurement of as little as an 0.1 mile per hour increase/decrease in the effective tread speed.

While the above described embodiment of the present invention is configured to determine the effective tread speed based upon a sensor reading obtained from the passing of a magnet on the pulley, it is to be appreciated that the rotational speed of the treads, the motor, the drive shaft, or any other drive assembly related component, and calibrations related thereto, may be suitably utilized by the TSS and/or MCU to determine the effective tread speed. Further, it is to be appreciated that various other types of sensors including, but not limited to, tachometers, potentiometers, optical sensors, and the like may be utilized by the TSS to provide the tread speed signals to the MCU.

In other embodiments, for example, embodiments wherein precise effective tread speed control is not required or necessary, the motor may also be controlled without requiring a feedback loop, such as the feedback loop provided by the TSS to MCU connection. In such an embodiment, the speed of the motor may be controlled based upon empirical, statistical or other data which specify the operating characteristics of the apparatus at a given input current level (or duty cycle) for the motor. Such data and operating characteristics may be further measured, determined and/or calibrated during testing based upon the weight of the exerciser and/or other factors. As such, it is to be appreciated that various embodiments of the present invention may utilize various devices and/or processes to control the effective tread speed.

Based upon TSS provided speed signals (when available), the MCU may also be configured to determine when to provide tread control signals to the TCU in order to accelerate or decelerate the motor in order to maintain the effective tread speed at a desired effective tread speed or within a desired effective tread speed range.

As mentioned previously, the effective tread speed, for at least one embodiment, may vary over a range of 0.7 to 4.0 miles per hour. The desired effective tread speed may be specified by an exerciser via an UII 50, which is connected to the MCU 10, for example, by incrementing or decrementing the desired effective tread speed using, for example, "+" or "−" buttons. The use of push buttons to increment or decrement control settings is well known in the art and is not discussed further herein. Additionally and/or alternatively, the effective tread speed may be controlled based upon non-exerciser inputs, such as those provided by pre-programmed routine, those provided by an instructor (for example, in an exercise class setting), or otherwise.

Step Sensor ("SS")

As discussed previously, various embodiments of the present invention may be configured to include a SS (40), for detecting whenever an exerciser takes a "step." In one embodiment, the SS is configured to detect the relative movement of a rocker arm. As described in the related applications, the rocker arm creates a dependency between the right and left treadles such that as one treadle falls (or travels towards the ground) the other automatically rises, and vice versa. Detecting and/or sensing the relative movement of the rocker arm may be accomplished utilizing, for example, a read switch (hereinafter, the "step switch") and a corresponding magnet (hereinafter, the "step magnet"). In this embodiment, as the right tread is moved in a first direction (i.e., up or down relative to an axis about which the tread may rotate), the step magnet attached to the rocker arm correspondingly passes by the step switch which generates a step signal 45 for communication to the MCU. Similarly, when the left tread is lowered, the rocker arm and the step magnet correspondingly moves in an opposite or second direction and past the step switch and generating a step signal 45. Regardless of the direction of rotation of the rocker arm, the read switch may be positioned to detect the up/down movement of the step magnet and thereby the rocker arm to which it is attached and correspondingly each step (which may be a full step or a portion thereof) taken by the exerciser. Such detections are suitably communicated to the MCU.

It is to be appreciated that the location of the step magnet relative to the axis about which the rocker arm rotates may determine the depth of each "step" (or up/down motion of a given tread) necessary for a "step" to be detected by the read switch. As such, in one embodiment of the present invention, the step magnet and corresponding step switch are positioned on the rocker arm so as to detect "steps" of at least one (1) inch of declination/inclination.

Further, it is to be appreciated that other devices may be utilized to provide step sensing as desired. Such devices include, but are not limited to, potentiometers, other forms of magnetic sensors, optical sensors, rotational sensors, encoders, and the like. Further, the position of any given SS along the rocker arm or elsewhere on the apparatus may also vary without departing from the spirit or scope of the present invention. For example, the SS may be suitably positioned such that a magnet affixed to one or more treads is utilized to detect the movement of such tread(s). Again, the position of such sensor relative to a given axis of rotation for the tread may determine the degree of step height measurable.

The SS, in at least one embodiment, may be configured to generate and output a step signal to the MCU. The utilization of the step signal by the MCU in determining various parameters, controlling operation of the apparatus, and/or determining exerciser performance characteristics is discussed in greater detail hereinbelow.

User Input Interface ("UII")

As mentioned above, at least one embodiment of the present invention includes one or more UIIs 50. Some UII embodiments may be configured to accept exerciser inputs, for example, via push buttons suitably provided on an exerciser interface. In other embodiments, exerciser instructions, information and other inputs may be communicated to the MCU, via a UII over communications link 55, by utilizing input devices which include, but are not limited to, keyboards, control wheels, biometric inputs (such as those provided by a heart rate monitor and/or other biometric sensors), voice inputs, and others. Further, the UII may be configured to accept inputs from external sources (i.e., sources other than the exerciser) such as an instructor of a group exercise class or an interactive fitness program (e.g., one provided via an associated audio-visual presentation or a software application running on a computer). Such inputs are then communicated to the MCU with or without processing by the UII. In short, the UII may be configured to communicate to the MCU, or otherwise, input control signals from a variety and a plurality of sources, both human and computer generated, and/or both local or remote to the apparatus.

User Output Interface ("UOI")

The various embodiments of the present invention also generally include one or more UOIs 60. Such UOIs are utilized to communicate, from the MCU to the user or others over communications link 65, real-time status information and/or pre- or post-exercise routine related information. Such information may include energy expended, "steps" climbed, feet gained, distance traveled, percentage of exercise above a given threshold (e.g., anaerobic or aerobic), and/or others. Further, such information may be communicated to an exerciser or other via practically any available output devices. Examples of those output devices supported by the various embodiments of the present invention include, but are not limited to: video display devices, such as light emitting diodes, liquid crystal display devices, flat panel displays, cathode ray tube displays, head-up displays, and visor based displays; audible display devices, such as speaker and headphones, both wired and wireless; hard-copy output devices such as printers; tactile output devices; and others.

The UOI may also be configured to output exerciser, status, performance, diagnostic and/or other information via a variety of communications links 65 ports and/or output devices. Example of output ports include, but are not limited to, serial port, parallel ports, USB ports, IR ports, and RF ports. Practically any type of display, output or presentation device may be supported by various embodiments of the present invention.

Control System Operation

The various embodiments of the present invention may be utilized, desirably, in at least one, some, or all, of three different modes: stepper only mode; treadmill mode and treadclimber mode. Each of these modes is discussed in greater detail hereinbelow. In certain embodiments of the present invention, only the treadclimber mode is supported. In other embodiments, the treadclimber and stepper modes are supported, the treadclimber and treadmill modes are supported or the stepper and treadmill modes are supported. As discussed in greater detail in the related applications, at least one embodiment of the apparatus includes a locking mechanism, which, upon activation, "locks" the left and right treadles parallel to each other so that the combined decking effectively provides a single platform. Other embodiments may not include this locking feature and other embodiments may not be configured to rotate the treadles while one is stepping upon them (i.e., the apparatus in certain embodiments may be configured to not operate in treadclimber mode). Thus, it is to be appreciated that the present invention may be configured into different embodiments of steppers, treadmills and treadclimbers as particular implementations and/or utilizations specify.

Stepper Only Mode

The apparatus may be configured to operate as a "stepper" (hereinafter, "S-mode"). When configured in S-mode, the MCU generally does not provide any tread control signals to the motor (or those signals, if any, the MCU does provide may be utilized to minimize or otherwise control the rotation of the drive shaft and, by extension thereof, the rotational motion of the treads). Since the motor may not be powered and the pulley is desirably not rotating, the MCU should not receive any tread speed signals from the TSS, when in S-mode. However, in the event that the tread magnet is aligned with the tread switch, the TSS may generate a continuous tread speed signal and the MCU may be configured to ignore this signal while in stepper mode. The MCU, however, does continue to receive step signals with each "step" initiated by the exerciser and to process such step signals so as to calculate the amount of "work" or calories currently being expended by the exerciser at that time.

More specifically, it is to be appreciated that users of exercise devices, such as the apparatus of the present invention, generally desire to receive current, elapsed and/or final indications of how much "work" is expended during a "workout," or a given segment thereof (such as, a snapshot in time, over a given interval, or over the extended period of a single and/or a plurality of workout sessions). Commonly, exercisers measure the amount of "work" performed during exercising in terms of calories "burned." In order to determine the number of calories "burned," one commonly needs two parameters: the $VO_2$ associated with a given exercise; and the weight of the exerciser. In general, the amount of calories "burned" per minute for a given exercise routine may be expressed by the following equation:

$$\text{Calories per Minute}=\text{Exerciser's Weight in kG}\times VO^2\times 0.005(\text{a constant}) \quad \text{(Equation \#1)}$$

The first part of this equation, the exerciser's weight, is directly or indirectly provided by the user of the apparatus. As discussed previously hereinabove, the MCU is configured to receive user inputs, via the UII, which may include the exerciser's weight. As such, the exerciser may directly provide their weight to the apparatus in order to calculate calories burned. Alternatively, the apparatus may be configured to indirectly receive the exerciser's weight information, for example, by using a "scale" to measure the weight of the exerciser. Various types of scales are well known in the art and may be utilized in conjunction with the present invention to determine an exerciser's weight.

As mentioned above, the second component necessary to determine the amount of calories burned for a given workout is $VO_2$. It is commonly appreciated that $VO_2$ varies based upon the type of exercise being performed (e.g., running, swimming, stepping, biking, weight lifting and the like) and the workout setting or resistance level associated with the exercise. For well established exercise routines, such as, running on flat grounds or on an incline, cycling, and stepping (for a given step height), the $VO_2$ expended has been well documented by the American College of Sports Medicine ("ACSM") and may be obtained from equations and/or charts provided by the ACSM.

For a stepper function, such as that provided by at least one embodiment of the present invention, when configured in S-mode, ACSM established formulas or other formulas may be utilized. However, in the present embodiment, a non-ACSM formula, as described hereinbelow, is utilized because of the interdependencies which exist between the left and right treadles. This formula may be used to determine the amount of $VO_2$ expended when performing a stepping action based upon the inches per minute "obtained" by the exerciser. In general, this relationship may be expressed by the following equation:

$$VO_2 \text{ stepping}=(HT\times 0.04)+3.5 \text{ (wherein "}H_T\text{"=total height gained in inches per minute)} \quad \text{(Equation \#2).}$$

In general, in order to determine $VO_2$, the MCU needs the total height "$H_T$" of all of the steps taken by the exerciser over a given time period. Since the actual height of any given step taken by an exerciser may vary from a previous or subsequent step, over an extended time period, $H_T$ may also vary. As such, it is commonly appreciated that an exerciser will often take steps of less than full height and, therefore, less than the optimal $VO_2$ will be expended by the exerciser over any given time period. In order to accurately reflect the amount of work actually performed by an exerciser, in general, an exercise apparatus, such as the various embodiments of the present invention should account for irregular stepping, as exemplified by less than full steps or extended duration steps (i.e., when the exerciser rests while stepping or when the step comes into contact with a bottom stop). Often, these variations in stepping and/or step height, and thus the determination of $V_2$ actually expended by the exerciser, may be calculated based upon measurements of the actual step height taken and the frequency of stepping. It is to be appreciated that in various embodiments of the present invention, the actual step height may be directly measured using potentiometers, encoders or the like.

However, other embodiments of the present invention may not include or utilize a potentiometer, encoder or other sensor to directly measure step height taken by an exerciser and, thus, the MCU cannot directly calculate the total step height $H_T$ over a given time period. Instead, the apparatus may be configured to determine $VO_2$ based upon those step signals generated by the SS. When the MCU is not provided with measured step height information, the MCU may be configured to extrapolate the step height, based upon the number of steps per minute by the exerciser "$R_{actual}$," as detected by the SS, in order to determine the $VO^2$ expended by the exerciser over a given time period.

More specifically, at least one embodiment of the apparatus may be configured to calculate the total step height $H_T$ based upon the number of step signals received per minute by the MCU from the SS times the default step depth "D" (in inches or other comparable measurements) credited to the exerciser based upon an average step rate $R_{avg}$. $R_{avg}$ may be determined based upon empirical studies, for example, those conducted at a constant resistance level for a constant exerciser's body weight.

For at least one embodiment of the present invention, the default step height D equals the maximum travel of the treads in an up/down motion, which is desirably six (6) inches. It is to be appreciated, however, that for other embodiments D may be larger or smaller. As D varies, the average step rate $R_{avg}$, may also vary. Thus, additional empirical studies may be necessary to determine $R_{avg}$ for other embodiments.

As such, for at least one embodiment, when the apparatus is in S-mode, an exerciser is credited with a maximum step depth D of six (6) inches whenever the actual number of steps per minute $R_{actual}$, as sensed by the SS, are less than or equal to a predetermined and empirically calculated average step rate $R_{avg}$ (wherein $R_{avg}$ equals the number of full steps the empirical average exerciser would have taken for a given weight and resistance level). As such, for an exerciser performing at or below the empirically determined average performance level (as measured in steps per minute), the work performed by the exerciser is related to the actual number of steps taken as set forth by the following formula:

$$VO_2=(R_{actual}\times D\times 0.04)+3.5 \text{ (wherein } R_{actual}\text{=actual steps per minute attained and D=the maximum step depth)} \quad \text{(Equation \#3)}$$

For example, a first exerciser weighs 175 pounds or 79.54 kGs and is optimally exercising at a first resistance level (i.e., $R_{actual}=R_{avg}$). Also, assume that $R_{avg}$ equals 40 steps/minute (i.e., based upon empirical studies, it may be determined that the first exerciser, optimally working out at a given resistance level, should be able to complete forty (40) full steps per minute). Further assume that D equals six inches (i.e., the maximum step depth is assumed to be six (6) inches). As such, the first exerciser, during each minute working out at this exertion level, should "obtain" a total step height $H_T$ (which may be defined as $R_{avg}\times D$) of: 40 steps×6 inches=240 inches/minute. Using the formula set forth above as equation #2, the exerciser's $VO_2$ therefore would be: (240×0.04)+3.5=13.1. Further, using equation #1, the calories burned per minute by the exerciser would be 5.2 cal/min.

In another workout, however, assume the first exerciser works out at a non-optimal rate of $R_{actual}$=25 steps per minute (with all other settings remaining the same). In this situation, the exerciser's total stepping height $H_T$ would be: $R_{actual}\times D$=25×6=150 and the resulting $VO_2$ would be: (25×6×0.04)+3.5=9.5. In short, by working out at less than the optimal performance level, the exerciser exerts less energy.

However, when the same exerciser, at the same resistance level steps at a rate higher than the empirical average rate, for example, when $R_{actual}$=65 steps per minute, while $R_{avg}$.=40 steps/minute, the MCU accordingly reduces the total step height $H_T$ by multiplying the maximum step depth D by the ratio of the empirical average number of steps $R_{avg}$. to the actual number of steps $R_{actual}$ and thereby arrives at a modified total step height $H_M$. The modified total step height $H_M$ may be used in equation #2 to determine $VO_2$, as follows:

$$VO_2=(R_{actual}\times H_M\times 0.04)+3.5$$

For example, when the first exerciser exercises at the first resistance level and has an actual stepping rate $R_{actual}$ of 65 steps per minute, $VO_2=(65\times(6\times(40/65))\times 0.04)+3.5=(65\times 3.69\times 0.04)+3.5=13.094\approx 13.1$.

As such, the foregoing example shows that when an exerciser steps at stepping rate which is higher than the empirically established stepping rate, the exerciser effectively expends the same amount of energy by effectively taking more steps of shorter depth, so as to result in the same amount of vertical gain as if the exerciser had taken fewer steps at the full step depth over a given time period.

In short, in order to determine the $VO_2$ expended by an exerciser of a given weight, at a given resistance level, for at least one embodiment of the present invention, the MCU uses the step signal from the SS, the previously or then provided exerciser's weight, and the current resistance level setting.

Figure 2:
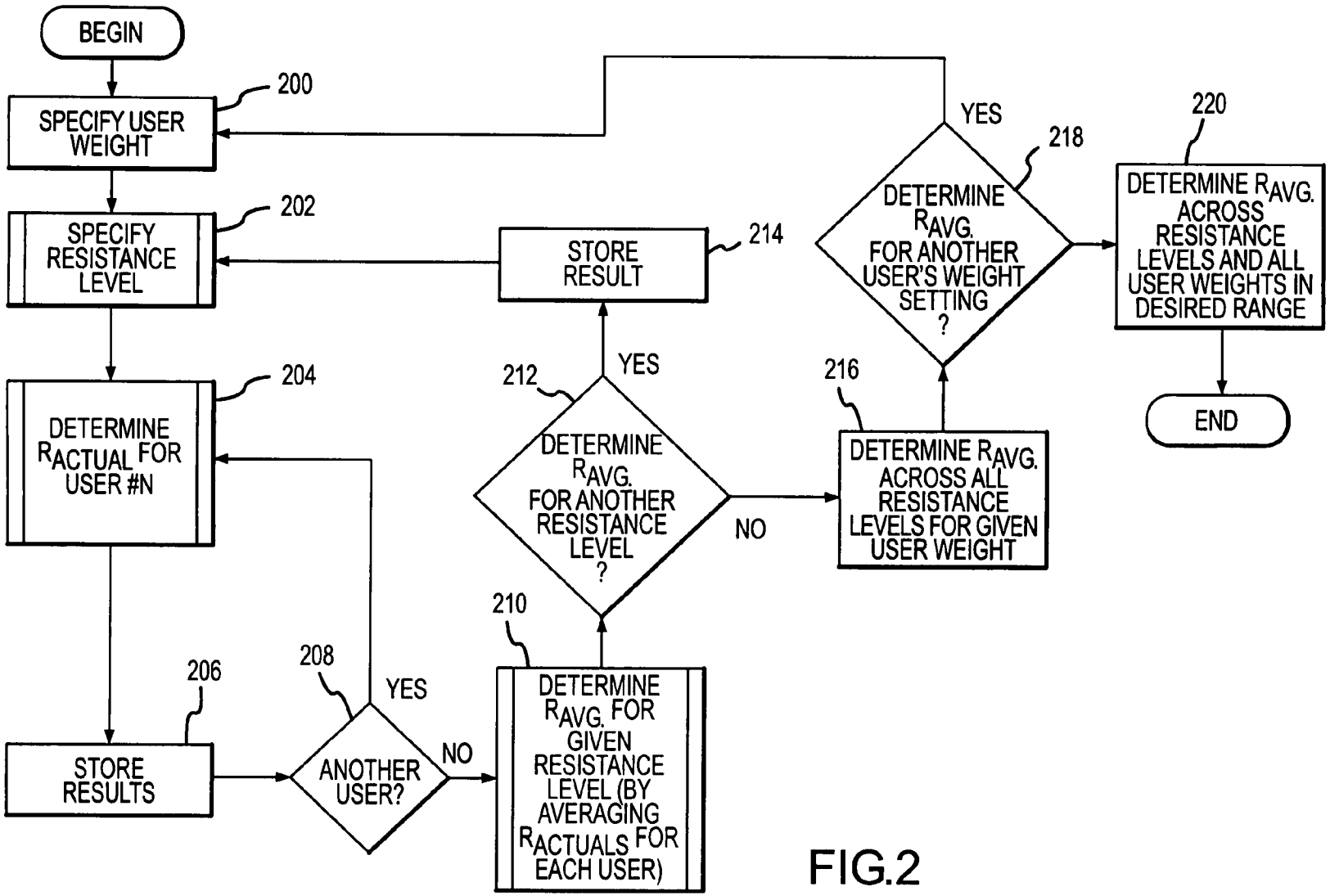
FIG. 2 is a flow chart illustrating the process steps which may be utilized in one embodiment of the present invention to calculate the amount of energy expended by a user of the apparatus.
Figure 3:
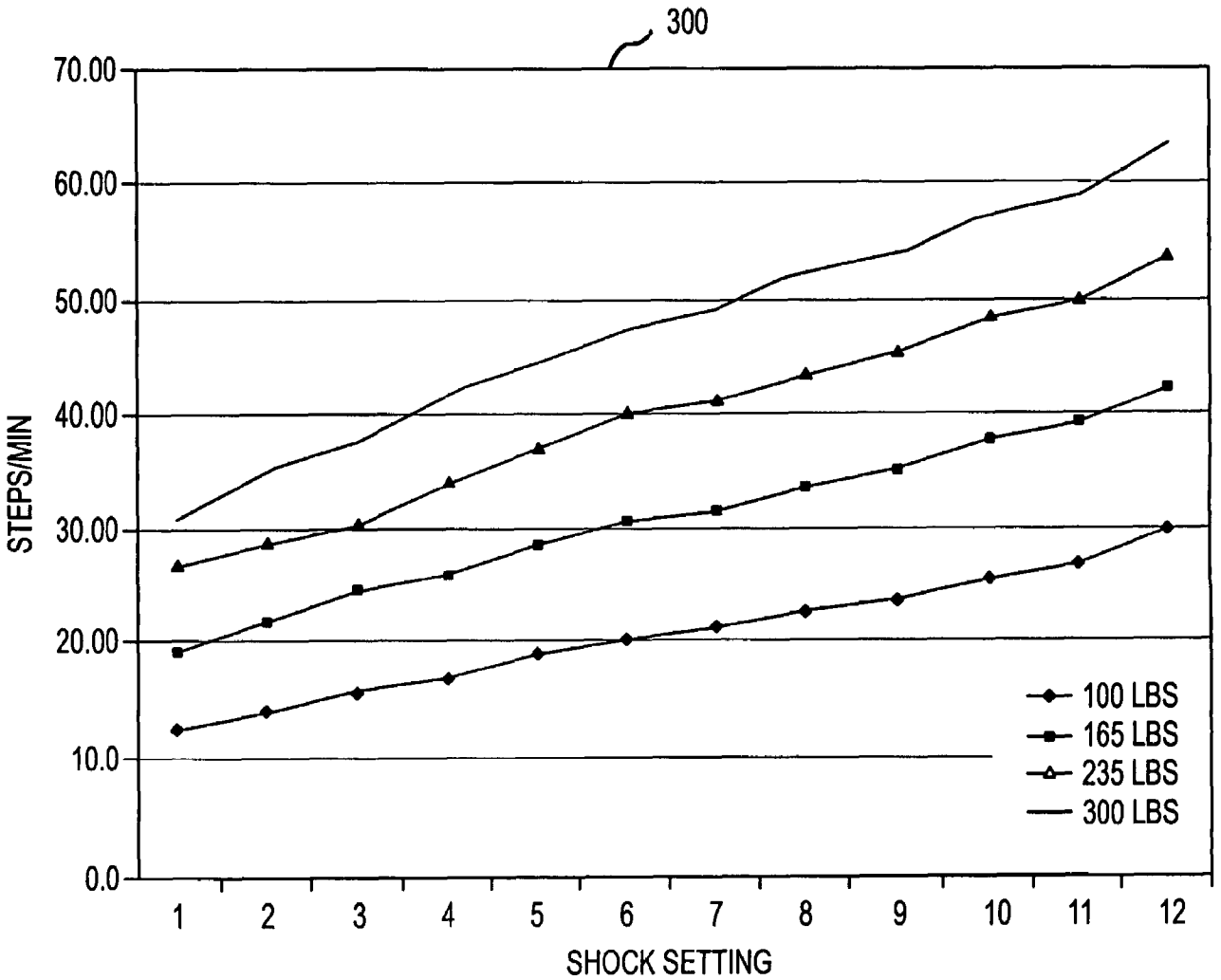
FIG. 3 is a graphical representation of empirical data which may be obtained in conjunction with use of the exercise apparatus in the stepper only mode.

As discussed above, the MCU may be configured to determine an exerciser's $VO_2$, without receiving an actual step height indication, by utilizing step signals and empirical data obtained during testing. This empirical data may be obtained by the process shown in FIG. 2. As shown, this process may begin with the specification of an exerciser's weight 200. It is to be appreciated, that a wide variety of exercisers of varying weights may use the apparatus. For the present embodiment, such weight range is specified as over the range of 100-300 pounds. However, other weight ranges may be supported, as desired, by other embodiments. Additionally, the process provides for the specification of a resistance level, for example, levels 0-12 202. At this point a first exerciser is tested to determine the actual number of steps they may take over a given time period (e.g., a minute) 204. These results are then stored 206, and subsequent exercisers of the same weight are then desirably tested, at the same resistance level, until a sufficient set of samples have been obtained 208. Based upon this sample set, averages and statistical operations may be applied to the sample set to determine the average resistance, $R_{avg}$., associated with an exerciser of a given weight at a given resistance level 210. It is to be appreciated that these tests and corresponding measurements can be accomplished using males only, females only and/or mixed gender sample sets. Once an $R_{avg}$. for a given weight and resistance is determined, the process may continue with determining $R_{avg}$. values across varying resistance levels and/or varying exerciser weights 212-214. These additional tests then, desirably, yield a second and a third, respectively, sample sets for which curve fitting, regression analysis, standard deviation, mean or other statistical and/or other mathematical operations may be performed in order to determine relationships between: $R_{avg}$. and a given resistance level across a range of exerciser weight settings 216; and $R_{avg}$. and an exerciser's weight across a range of resistance level settings 218-220. For example, FIG. 3 shows one example of curve fitting 300 which may be used to determine the $R_{avg}$. associated with a given exerciser weight across a plurality of resistance levels. As shown, it is to be anticipated that the relationship between $R_{avg}$. and resistance level, at a given weight setting, is substantially, but not perfectly, linear.

In short, it is to be appreciated that the $VO_2$ expended by an exerciser will vary based upon the resistance level set for the apparatus and the fitness level of the exerciser (i.e., exercisers in less than desirable fitness may not be able to maintain $R_{avg}$. throughout an exercise routine). In short, the higher the resistance level, the greater the amount work that may need to be performed in order to depress a step a full step height. Similarly, the amount of time necessary for a step, at a given resistance level, to be depressed the full height distance may also vary based upon the weight of the exerciser.

It is to be appreciated that the relationship between weight, resistance level, and $R_{avg}$. may also be expressed in a data structure, such as a table. For example, a given $R_{avg}$., at a given resistance level may be expressed in a data structure as a function of the exerciser's weight, as shown below in Table 1. In general, it is believed that empirical testing may show that the number of steps taken by a heavier exerciser are usually greater than those taken by a lighter exerciser, over a given time period, when both exercisers are working out at the same resistance level. Using such data, the MCU can compare the actual number of steps to a given $R_{avg}$. for an exerciser of a specified weight, at a given resistance level, and extrapolate the total step height HT attained by the exerciser and the $VO_2$ expended by the exerciser.

TABLE 1

| Resistance Level | $R_{avg}$. for Exerciser Weight of 125 lbs. | $R_{avg}$. for Exerciser Weight of 150 lbs. | $R_{avg}$. for Exerciser Weight of 175 lbs. |
|---|---|---|---|
| 1 | 20 | 22 | 24 |
| 3 | 24 | 26 | 28 |
| 6 | 28 | 30 | 32 |
| 9 | 32 | 34 | 36 |
| 12 | 36 | 38 | 40 |

(Values provided for illustrative purposes only and are not based upon empirical results)

Similarly, the beforementioned relationship may also be expressed as a mathematical formula or algorithm. Curve fitting software such as DATAFIT Version 6.1.110, manufactured by Oakdale Engineering may be utilized to obtain such mathematical formulas based upon empirical testing results.

Therefore, when configured in S-mode, at least one embodiment of the present invention may be configured to determine the amount of work, $VO_2$, expended by an exerciser at a given resistance level. Based upon this determination of $VO_2$, the calories burned by the exerciser per minute calculated using equation #1 or other suitable calculation.

As discussed above, the MCU may also be configured to determine calories burned by the exerciser over a given time period, such as a period of minutes for a given workout, or the like. As desired, exerciser performance data may be suitably stored by the MCU directly or indirectly in a memory or storage device (for example, in remote or removable storage or memory device), utilized for additional performance measurements, and/or used for any other purpose. The stored data may then be mathematically, statistically or otherwise manipulated and/or analyzed to reach desired results, such as, total energy expended, average steps per heart rate and others.

Treadmill Only Mode

Another mode the apparatus may be configured to operate in is treadmill only mode (hereinafter, "T-mode"). When in T-mode, the left and right treads are desirably fixed at a given incline. In one embodiment, such incline is set at a ten (10) degree slope, but, in other embodiments, other degrees of slope may be utilized.

In T-mode, the MCU desirably outputs tread control signals to the TCU (thereby controlling the speed of the treads)

and receives tread speed signals from the TSS. Also, the MCU desirable receives a steady-state step signal from the step sensor, indicative of the treads being positioned in the ten (10) degrees of slope configuration. It is to be appreciated, however, that the step magnet and the step switch may be configured so as to not generate a step signal when the treads are configured for T-mode. As such, the MCU may be suitably programmed so as to utilize or not utilize any output signals provided by the SS when in T-mode. However, from a control aspect, desirably, the SS outputs a steady state step signal so that the absence of such signal may be utilized by the MCU to detect a drop in the relative position of a given tread (and/or the corresponding rise in the opposite tread). Such a drop may be symptomatic of the treads becoming unlocked or other error conditions.

When in T-mode, the determination of the amount of work expended by an exerciser while exercising may be determined by using ACSM established determinations of the $VO_2$ expended by an exerciser of a given weight on a treadmill of ten (10) degrees incline at a given miles/hour. These calculations and the algorithms associated therewith are well known in the art. As such, the MCU may access such ACSM algorithms, tables, or the like to determine the amount of work and the calories burned by an exerciser of an embodiment of the apparatus in T-mode.

TreadClimber Mode

Another mode the apparatus may be configured to operate in is referred to hereinafter as TreadClimber mode or "TC-mode". As discussed herein in greater detail, when in TC-mode the apparatus functions as both a stepper and a treadmill (i.e., it facilitates stepping and striding in a combined motion). Input signals may be received by the MCU from both the TSS (providing an indication of the effective tread speed) and the SS (providing an indication of the steps per minute). When in TC-mode the MCU may also be configured to output tread control signals to the TCU and/or other output signals.

For at least one embodiment of the apparatus of the present invention, when in TC-mode, the amount of work or $V_2$ expended by an exerciser may be based upon empirical studies and the effective tread speed. These studies generally collect data points indicative of the $VO_2$ expended by an exerciser over a range of resistance levels and at a range of effective tread speeds. As is commonly appreciated, $VO_2$ is independent of the weight of the exerciser. As such, these empirical studies may be performed at a variety of exerciser weights, for given resistance levels and effective tread speeds. As discussed further hereinbelow, empirical studies commonly are conducted using heart rate monitoring as well as respiratory exchange monitoring.

Figure 4:
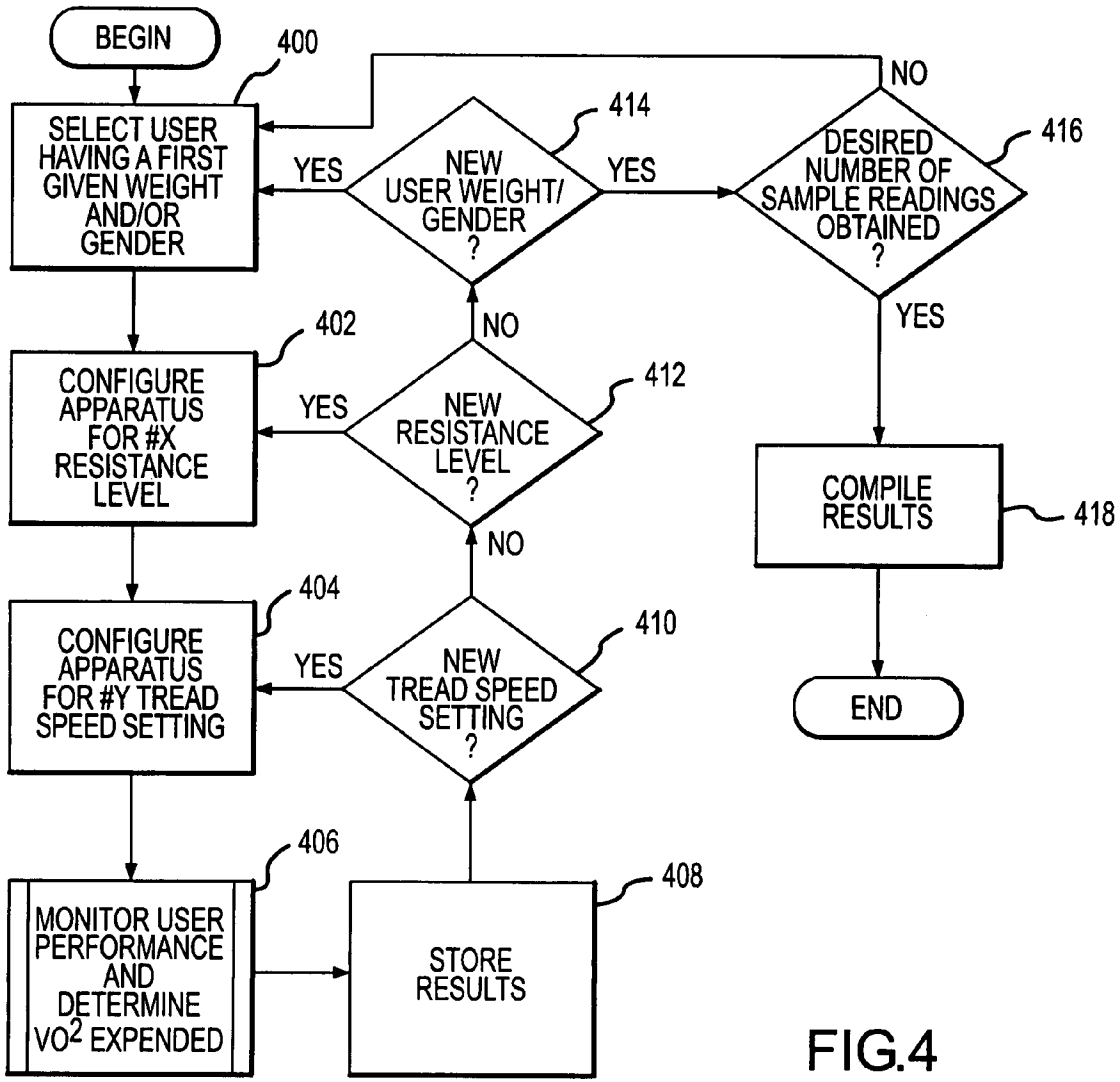
FIG. 4 is a flow chart illustrating, for one embodiment of the present invention, one process by which the amount of energy expended by a user of the exercise apparatus when in combined treadmill and stepper mode may be determined.

With reference to FIG. 4, one process by which $VO_2$ may be calculated for an exerciser of an embodiment of the present invention is set forth. As shown, this process may begin with selecting an exerciser having a first given weight (for example, an exerciser weighing 120 pounds) and, if desired, by gender 400. The exerciser is suitably warmed-up, as set forth by established testing protocols, and the resistance level for the apparatus is set to a first level, for example, level 1 402. The apparatus also is configured for a first tread speed setting, for example, 1 mile/hour 404. Based upon these settings, the exerciser's performance, heart rate and other biometric indicators are monitored 406. Based upon this monitoring the amount of $VO_2$ expended by the exerciser may be determined, recorded and saved 408. The process may be repeated, as desired, for a different tread speed setting while holding the resistance level constant, at a different resistance level while holding the tread speed setting constant, for a different exerciser weight, or for any other purpose 410-412-414. The results of these collective measurements may be used to define and/or refine $VO_2$ calculations across a range of resistance levels, effective tread speeds, exerciser weights, gender and other parameters.

Figure 5:
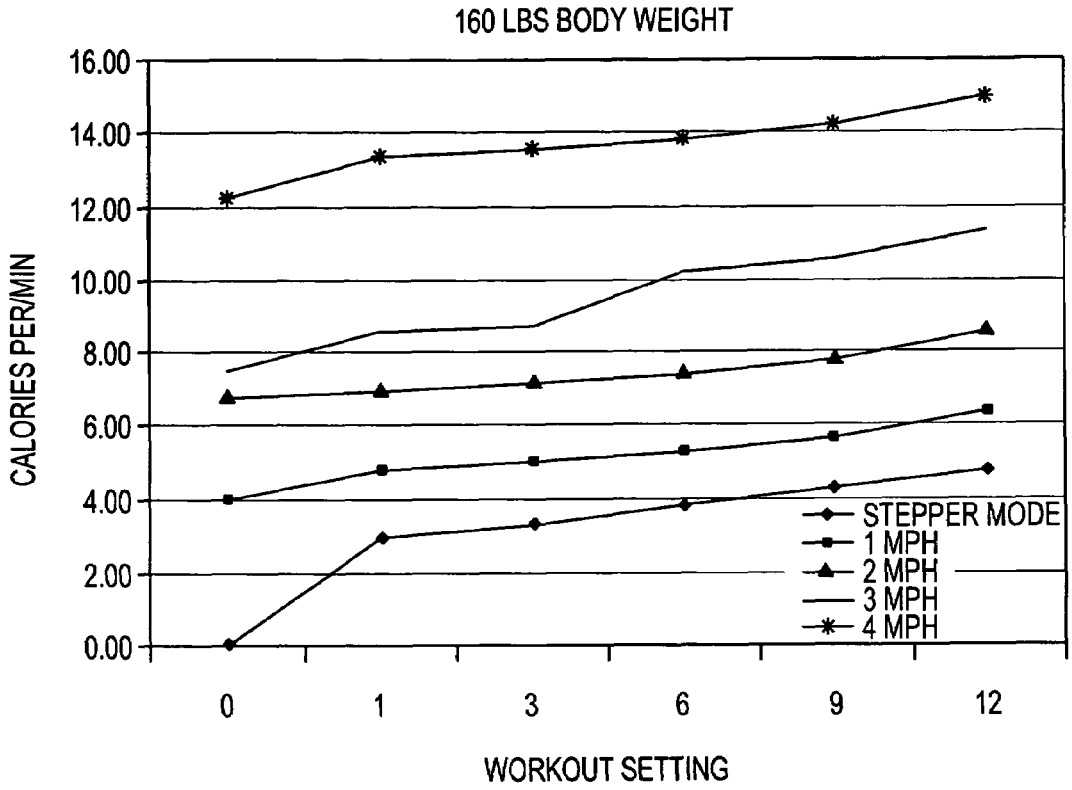
FIG. 5 is a graphical representation of empirical data which may be obtained in conjunction with the use of the exercise apparatus in the combined treadmill and stepper mode when the effective tread speed is held constant while varying the resistance level.
Figure 6:
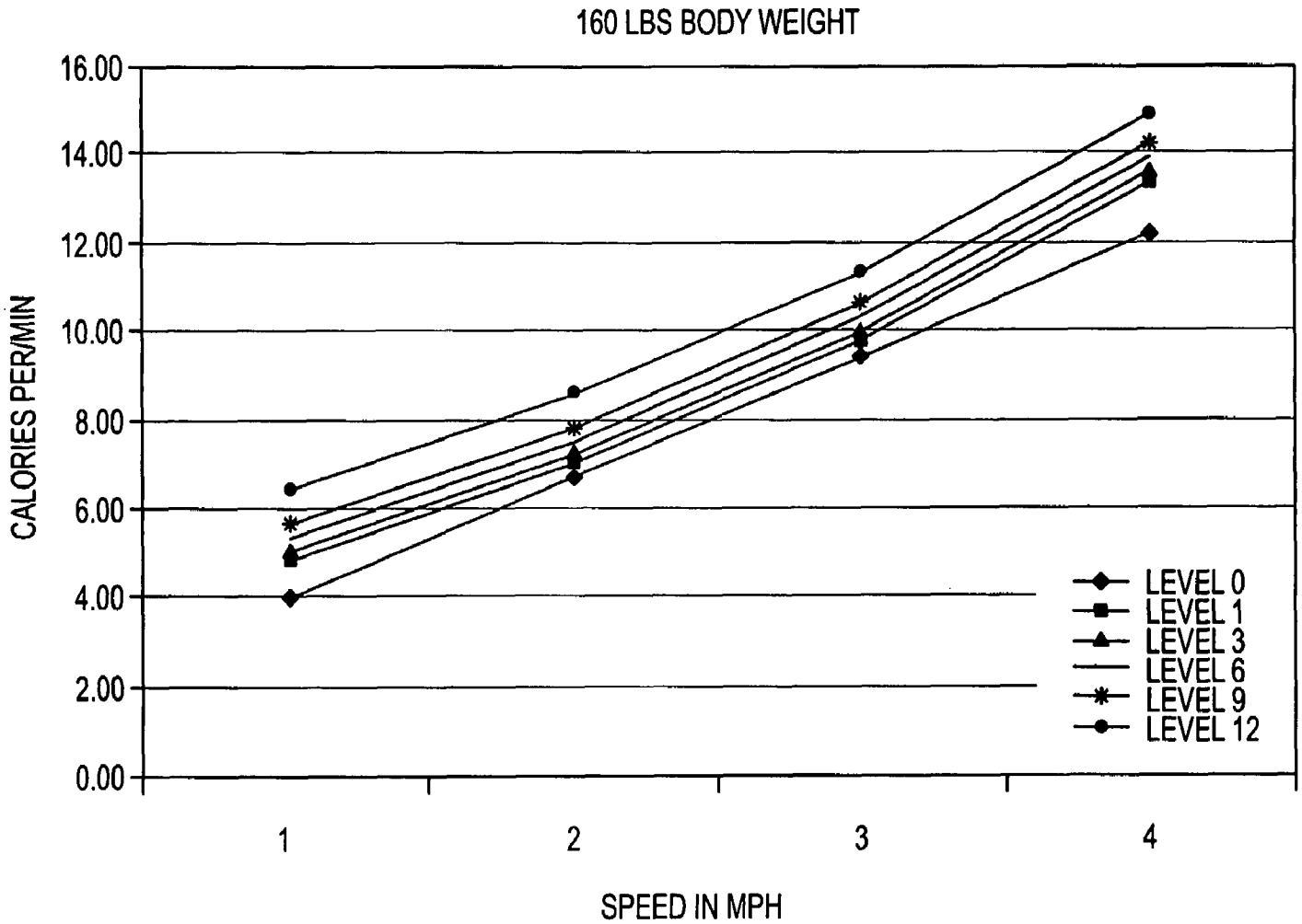
FIG. 6 is a graphical representation of empirical data which may be obtained in conjunction with the use of the exercise apparatus in the combined treadmill and stepper mode when the resistance level is held constant and the effective tread speed is varied.

Preferably at least ten (10) data samples are collected for each combination of resistance level and effective tread speed. As discussed previously, the $VO_2$ expended should not vary based upon exerciser weight, however, for statistical sampling purposes, data is collected based upon exercisers of varying weights. Once the desired number of data samples are collected 416, such data points may be suitably compiled and may be graphed, listed in tables, "curve-fitted" (for example, using the before-mentioned curve-fitting software or comparable software) or otherwise manipulated in order to determine the $VO_2$ associated with a given resistance level and effective tread speed 418. One example of the results of measuring the calories per minute expended by a 160 pound exerciser of an apparatus of the present invention is shown in FIG. 5. In this figure, the effective tread speed is held constant while the resistance level (as specified by the "Workout Setting") is varied. As such, a substantially proportional increase in calories per minute occurs as the resistance level is incremented from an "easy" workout setting of level 1 to a "difficult" workout setting of level 12. In contrast, FIG. 6 provides a representation of the calories per minute expended by a 160 pound exerciser at given resistance levels as the effective tread speed is increased. As shown in FIG. 6, a one mile per hour increase in the effective tread speed results in an increase of approximately 2.5 calories per minute, for this empirical study.

Figure 7:
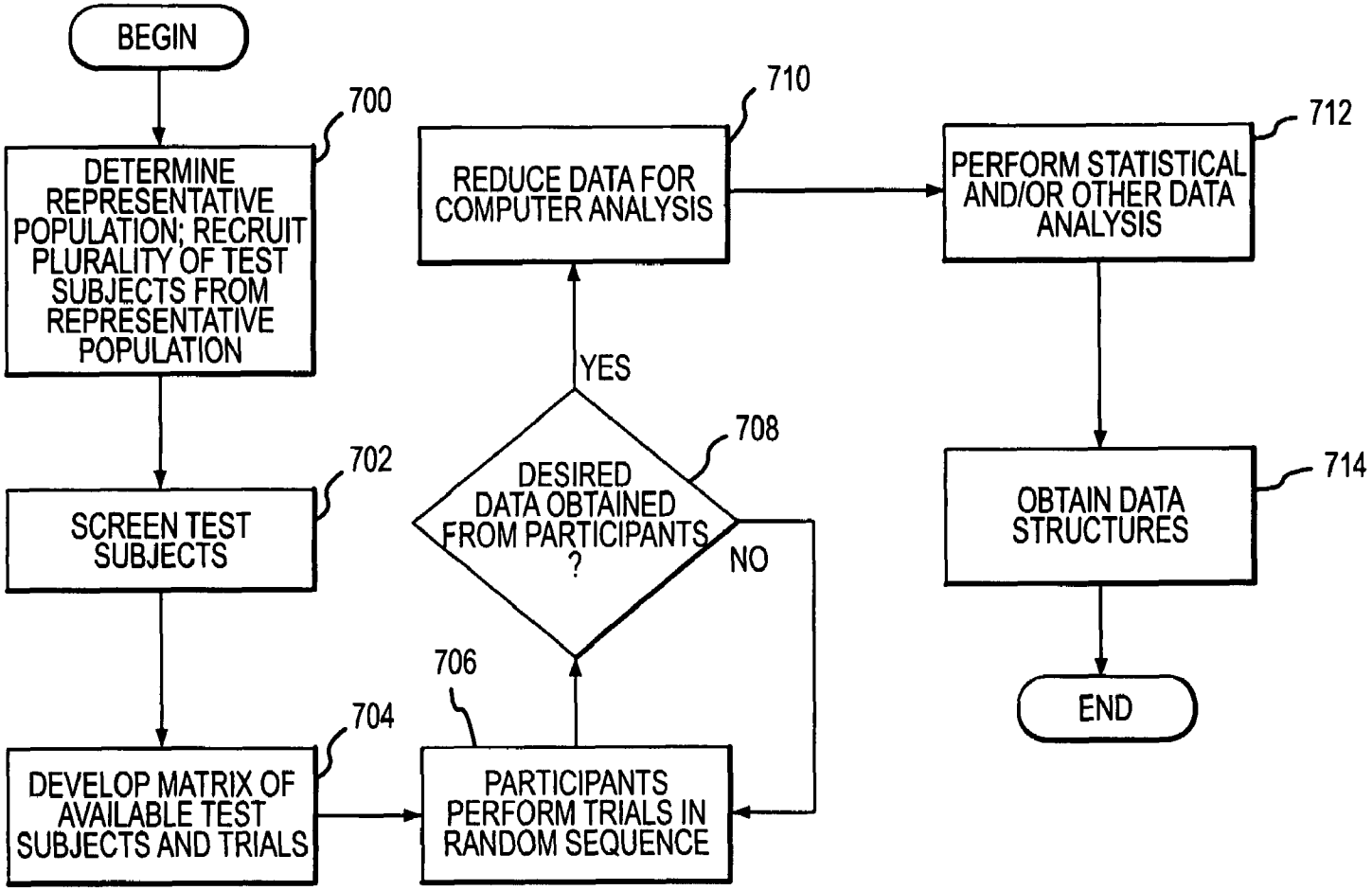
FIG. 7 is a flow chart illustrating, for one embodiment of the present invention, one process by which empirical data may be obtained for use in calculating the amount of energy expended over a range of resistance levels and effective tread speeds.

Another embodiment of a process by which empirical data may be obtained and used to calculate the $VO_2$ associated with a range of resistance levels and effective tread speeds is shown in FIG. 7. As shown, this process begins with recruiting test subjects from a population which desirably varies in demographics 700. For example, for one study performed in conjunction with at least one embodiment of the present invention, the population of test subjects was obtained from the population of Adelphi University students, faculty and staff.

Next, the representative sample of test subjects are screened for testing compatibility 702. It is to be appreciated that such screening may be accomplished using PAR-Q screening, medical history reviews and/or other known techniques.

A matrix may then be developed which identifies available test subjects (i.e., those having passed the screenings) and the trials desired 704. For at least one embodiment, a cover-over design may be employed in developing the matrix so that all available test subjects (hereinafter, "participants") perform all of the trials.

Next, each of the participants perform all of the desired trials in a randomly selected sequence so as to eliminate any familiarization basis 706. During testing, metabolic testing may be performed with open circuit spirometry using, for example, a Max II, Fitco Metabolic System, which are manufactured by Fitco Instruments of Quogue, N.Y. During this testing, high and low calibration gases are desirably employed to ensure standards of calibration for both oxygen and carbon dioxide analyzers, the availability and use of which are well known in the art. Further, a three (3) liter syringe, such as one manufactured by Warren Collins or the Hans-Rudolph Company, may be used to calibrate ventilatory volumes. Further, any obtained metabolic data may be converted from BTPS to STPD conditions by obtaining ambient temperature, relative humidity and barometric pressure immediately prior to each trial. Desirably, but not necessarily, testing should be performed under laboratory conditions which adhere to the guidelines for testing set forth by the ACSM, such as those set forth in ACSM's *Guidelines for Exercise Testing and Prescription,* $6^{th}$ Edition, Lippincott Williams & Wilkins, 2000, the entire contents of which are incorporated herein by reference. Further, the trials, desirably, are also conducted under laboratory conditions set forth by the Australian Sports Commission, such as those set forth *Physiological Test for Elite Athletes*, Human Kinetics Publication, 2000, the entire contents of which are incorporated herein by reference.

Further, for at least one embodiment of the present invention, each trail is desirably continued until steady state is confirmed by the participant's heart rate (±5 beats per minute), oxygen consumption (±150 mL of Oxygen per minute), and ventilation (±3 Liters per minute). It is to be appreciated that the participants' heart rate may be obtained by POLAR telemetry or other heart monitoring devices. The participant's heart rate is monitored continuously during each trial. Further, a mean heart rate obtained during the last 15 seconds of each minute may be used for data acquisition. A subjective Rating of Perceived Exertion (RPE) may also be obtained during the last minute of each trial using, for example, the Borg Category Scale of Perceived Exertion (*Borg's Perceived Exertion and Pain Scales,* Human Kinetics Publication, 1998).

Once all of the beforementioned data has been obtained from all of the participants for all of the desired trials (as specified in the matrix) 708, the process continues with reducing the data for computer analysis 710. It is to be appreciated that various system and/or processes may be utilized to reduce the data for computer analysis. For at least one embodiment, such analysis includes calculating means and standard deviations for the data, across the various testing regimens, for each variable and for each trial 712. Statistical analysis, using for example ANOVA, may also be applied to such data, the means and/or the standard deviations. Also, t-testing at a probability P of less than 0.5 level of significance may be applied to the data.

Based upon the results of the beforementioned statistical and/or other data analysis, data points are obtained that can be mapped or "curve-fitted" (as discussed previously hereinabove) in or order to obtain graphs, tables, algorithms, data structure or the like which describe, specify or otherwise set forth the relationships between resistance levels, effective tread speeds, $VO_2$, calories burned per a given time period, and/or any other parameter as desired by specific implementations of the present invention 714.

To summarize, it is to be appreciated that a variety of testing regimens may be utilized to obtain empirical values for $VO_2$ data/information, across a range of exercise regimens. Such data/information may be provided to or stored in the MCU, or other local or remote computational units, such that the various embodiments of the present invention may be configured to accurately calculate the calories per minute expended by an exerciser of a given weight based upon the selected effective tread speed and the selected resistance level when in TC-mode. It is to be further appreciated that such empirical testing regimens may also be applied to the other exercise modes discussed herein, to combinations of exercise modes and/or to combinations of such exercise modes with and/or apart from the utilization of an embodiment of the present invention.

Configuring Apparatus for Various Modes

Figure 8:
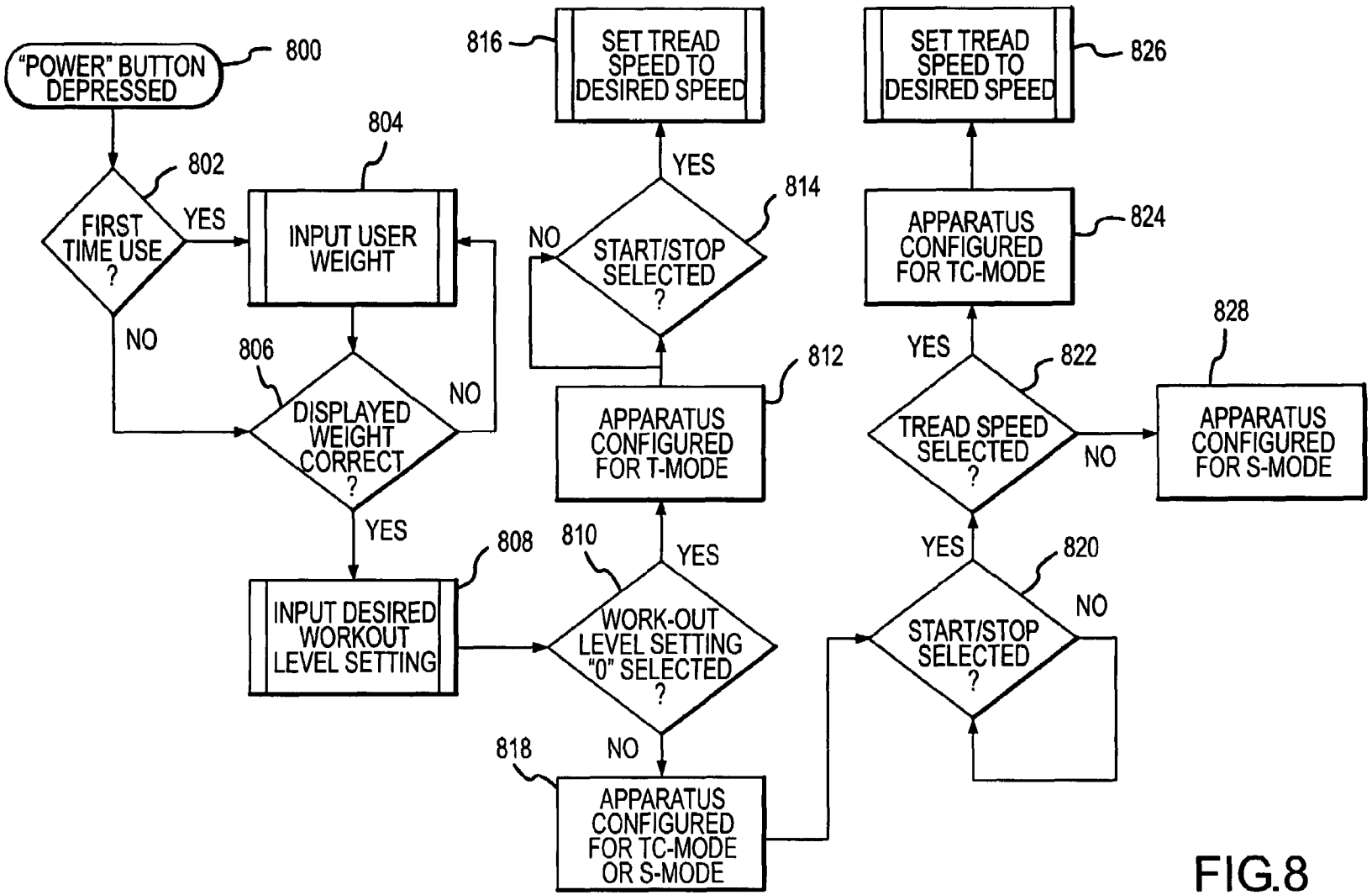
FIG. 8 is a flow chart illustrating, for one embodiment of the present invention, one process by which the exercise apparatus may be configured for use.

As discussed hereinabove, at least one embodiment of the apparatus of the present invention may be configured to operate in one of three modes: S-mode, T-mode or TC-mode. In order to quickly, and with a minimum number of exerciser inputs, specify to the MCU which mode the exerciser desires the apparatus to operate in at any given time, the following process/conventions have been established for at least one embodiment of the present invention, as shown in FIG. 8, with reference to FIG. 9.

The initialization of the apparatus, for at least one embodiment of the present invention, may suitably begin with depressing the "power" button 800. Other techniques for starting the apparatus may also be employed, such as, by beginning to depress the pedals. Following power being applied to the apparatus, the MCU may request various information, such as the exerciser weight may be requested and the exerciser may input such information, for example, by using the faster ("+") and slower ("−") speed buttons. Further, if the apparatus has been previously used, the apparatus may be configured to automatically display the last exerciser's weight and such weight may be changed as desired 802-804-806.

The desired resistance level or "workout setting" may also be inputted into the MCU 808. It is to be appreciated that the actual resistance level for certain embodiments of the present invention may be manually adjusted using the workout level dials on each hydraulic cylinder and by entering a corresponding input into the MCU via the UII. However, it is to be appreciated that the present invention is not limited to manually adjusted resistance levels, and that other embodiments may include resistance levels that are set automatically or semi-automatically set under the direction and/or guidance and control of the exerciser, the MCU and/or other local or remote controller, processors or other devices. Such resistance levels may be suitably controlled by hydraulic, pneumatic, electromechanical, mechanical, electromagnetic, separately or in combinations thereof, and/or using other method, processes, or devices which may be used or configured to control the resistance level or "workout setting" of any particular embodiment of the present invention.

Referring again to FIG. 8, when the inputted resistance level is set at "0" 810, for at least one embodiment of the present invention, the MCU desirably proceeds into T-mode 812. When in T-mode, the exerciser may initiate the rotation of the treads by various inputs, for example, pressing the "start/stop" button 814. Further, the exerciser or the MCU may specify a desired effective tread speed 816. When specified by the exerciser, the effective tread speed, as detected by the TSS and determined by the MCU, may be increased or decreased by utilizing the "+" and "−" buttons, respectively.

Alternatively, when the inputted resistance level is set over the range of 1-12, the MCU desirably configures the apparatus for either TC-mode or S-mode 818. The exerciser may initiate the rotation of the treads by pushing the start/stop button, an increment button, or otherwise 820. The MCU then determines whether the apparatus is to operate in TC-mode or S-mode based upon whether an effective tread speed is selected by the exerciser or the MCU 822. In at least one embodiment of the present invention, the exerciser may specify a desired effective tread speed and, in so doing, specify that the desired operating mode is TC-mode 824-826. In short, when a tread speed and a resistance level is specified by either the MCU or the exerciser, the apparatus operates in TC-mode. When only a resistance level is specified, the apparatus desirably operates in S-mode 828. And, when only an effective tread speed is specified, the apparatus operates in T-mode.

Thus, by specifying a resistance level and an effective tread speed (if any) the apparatus may be configured by the exerciser and/or by the MCU to operate in any of the three specified modes. The mode utilized at any given time during a workout routine, however, may vary as the routine specifies. Such variations may be accomplished automatically, semi-automatically or manually. It is also to be appreciated, that other processes and/or devices for specifying the desired mode of the apparatus may be used. Such processes and/or devices include, but are not limited to, push buttons, menus, programmed routines (which may instruct the apparatus to switch between the various modes during a workout routine), externally directed modes (for example, a mode specified by an instructor during a group exercise), or otherwise.

Alternative Embodiments

While the foregoing discussion has been primarily directed to a single embodiment of the present invention, it is to be appreciated that the present invention is not so limited. As discussed in general above, the present invention may be configured to utilize a wide variety of control units, sensors, actuators, inputs, and outputs. More specifically and with particular reference to the control unit and/or data processing aspects of the present invention, it is to be appreciated that a wide range of controllers/processors may be utilized. In some embodiments, a processor/controller may not even be included. As such, the range over which the MCU may operate generally includes essentially "dumb" processors, which may provide little, if any, control functions and/or capabilities and which may be configured to primarily receive data inputs and generate outputs for display to the exerciser, to highly advanced processors, such as those which utilize advanced microprocessor architectures (for example, PENTIUM microprocessors). Such processors may be combined with other devices to provide personal computer like capabilities, features and functions, and may be configured such that such processor(s) may control various if not all of the features, operations and functions of the present invention as discussed hereinabove, as well as provide additional features, functions and/or control capabilities. Thus, it is to be appreciated that the various embodiments of the present invention are not limited to those described herein and that other embodiments may be utilized to control the features, functions and operations of the apparatus.

Further, the various embodiments of the present invention may include a wide variety, quantity, quality, range and type of sensors and/or sensing devices. As discussed above, the present invention may be configured to include practically any sensor that is compatible with a given implementation of the present invention. Such sensors may be configured to monitor various, any and/or all of the features and/or functions of the apparatus. Some of these functions may relate to how an exerciser utilizes and/or enjoys the apparatus. Sensors, for example, may monitor speed, inclination, step height, step depth, impact of the exerciser's foot upon the treads (for example, to determine whether the exerciser steps heavily or lightly and to adjust system performance based thereon), pressure applied by the exerciser to any handles (for example, to determine if the exerciser is "cheating"), heart rate or other biometric indicators of the exerciser's physical condition, stride length (for example, in order to determine whether the treads should be shifted towards or away from the console in order to provide the exerciser with a more optimal and/or comfortable workout), and others. Similarly, sensors may be provided which separately or in a multifaceted role monitor parameters other than those related to the exerciser's experience. Such parameters may include motor hours, shock or hydraulic system use (for example, how many compressions a shock has performed in order to determine when servicing may be needed), and other parameters.

Just as the various embodiments of the present invention may be configured to process inputs provided by a variety of sensor and input devices, such embodiments may also be configured and/or configurable to control a wide range of actuators. As discussed above, one such actuator is the motor, which drives the treads. Other actuators may include, but are not limited to: step height actuators (for example, actuators which adjust the step height and/or the step depth based upon an exerciser's height, a type of desired workout, or the like); tread actuators (for example, actuators which may control the speed, angle, orientation and other aspects of a single or both treads); shock or dampening resistance actuators (for example, electromagnetic resistive devices, hydraulic, pneumatic and others types of devices may be used to control how quickly or with how much energy a tread will rise or fall); environmental actuators (for example, cooling fans, heaters, audio-visual devices, and others which relate to or concern an exerciser's experience with the apparatus); safety actuators (for example, those which are designed to prevent injury to an exerciser or others); and other actuators. In short, embodiments of the present invention may be configured with actuators that manually, semi-automatically or automatically control practically any aspect of the operation, configuration, and/or use of the apparatus.

With regard to inputs provided to a control unit(s), inputs may be provided by any of the beforementioned controllers (for example, inputs from a slave or remote control device, such as the TCU), sensors and actuators. Further, inputs may be provided by exercisers. Exerciser inputs, for example, may run the gamut from demographic indicators (e.g., height, weight, age, smoking/non-smoking), to medical history information (for example, whether the exerciser has had a heart attack or has heart disease—thereby providing a greater emphasis upon controlling the workout based upon the exerciser's heart rate, or requiring a longer cool-down period), to workout goals, or other information. Inputs may also be provided by others and/or other devices, systems or processes. For example, various embodiments of the present invention may be configured to operate in a group or class setting wherein an instructor or others specify a goal for the effective tread speed, resistance levels, target heart rate, and others. Such "goals" may or may not be adapted or custom tailored by the MCU in each apparatus as particular exerciser requirements may specify (for example, an apparatus associated with an overweight exerciser in a class may be tailored to operate at a lower starting resistance level (while still increasing or decreasing the resistance levels during the workout, as specified by an instructor) than the instructor or a triathlete in the same class setting may utilize. Further, inputs may be provided by automated systems, such as workout videos which may include triggers in the video signal that indicate to the apparatus when to change a setting for a given actuator. Similarly, inputs may be provided by remote or local computer programs, software routines and other devices.

Figure 9:
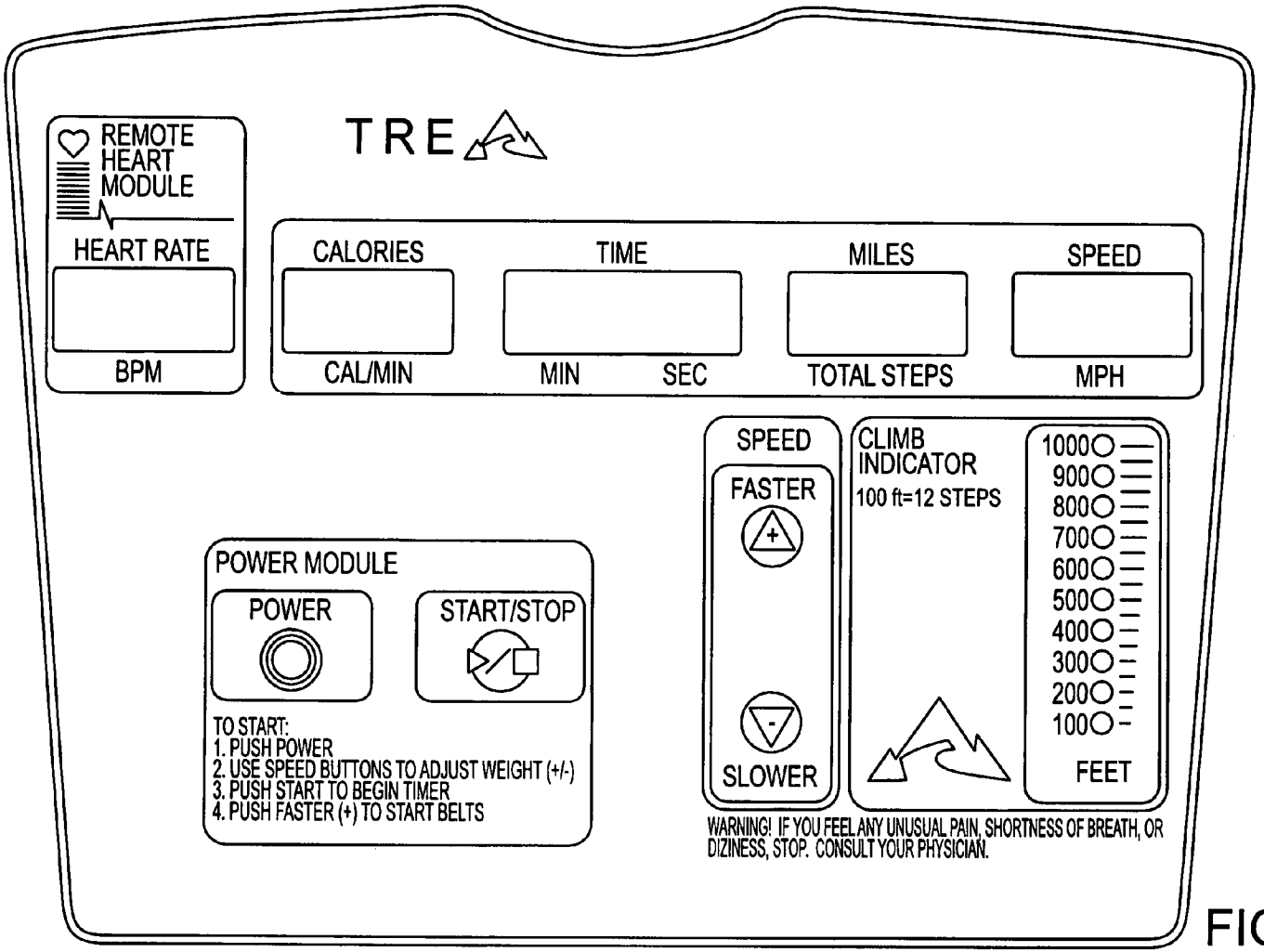
FIG. 9 is a pictorial representation of a user interface for one embodiment of the present invention.

Also, a wide variety of outputs may be provided by various embodiments of the present invention. One embodiment of a User Interface is shown in FIG. 9. As discussed above, output signals to actuators may be provided by the MCU or other processors. Also, output signals to exercisers may be provided in the context of audio, visual, tactile or other signals. Other signals may also be output by the apparatus including performance levels for an apparatus/exerciser. For example, in a group or class setting, such level and exerciser performance level information may be provided to the instructor so as to ensure exercisers do not over or under exert. Similarly, such performance information may be provided to monitoring services. For example, a heart attack patient's performance data (such as workout level, maximum heart rate obtained, average heart rate and the like) may be provided to emergency monitoring services, to doctors or therapists (for patient monitoring), or to others, including the exerciser. Also, equipment performance data may be provided to manufacturers, researchers or others, for example, over a wired or wireless Internet connection, for purposes of assistance with use, troubleshooting, trending and other diagnostic applications.

Utilizing a variety of control, sensor, actuator, input, and/or output possibilities, the various embodiments of the present invention may be configured to support a wide range of settings and operations. For example, an embodiment may be configured to support the switching between the three different modes during a work-out based upon an exerciser or other input. An apparatus may be provided which supports the changing of the horizontal or vertical axis about which a tread pivots, the depth of such pivot, the height of a step and/or other settings. Embodiments may be provided which include cross-talk capabilities between multiple apparatus, for example, using wired or wireless communication links. Embodiments may be provided which support the recording of exerciser performance and/or setting configurations on removable smart cards—such an embodiment may be desirable in gym, hotel or other settings.

SUMMARY

It is to be appreciated that the present invention has been described in detail with respect to certain embodiments and examples. Variations and modifications may exist which are within the scope of the present invention as set forth by the claims, the specification and/or the drawing figures.

The invention claimed is:

1. An exercise apparatus comprising:

a frame;

at least one treadle having at least one tread;

a master control unit;

a first sensor, in communication with the master control unit, which generates a first signal indicative of an effective tread speed for the apparatus;

a resistive element operably coupled with the at least one treadle, the resistive element including at least one resistance level; and a second sensor in communication with the master control unit wherein the at least one treadle is pivotally attached to the frame to perform a downward movement in response to an increase in a force applied by a user and to perform an upward movement in response to a decrease in the force applied by the user; and wherein the second sensor generated at least one second signal with at least one of the downward movement and the upward movement of a treadle.

2. The exercise apparatus of claim 1, wherein the master control unit calculates an amount of energy expended based upon the first and second signals.

3. An exercise apparatus comprising:

at least one treadle having at least one tread;

a master control unit;

a first sensor, in communication with the master control unit, which generates a first signal indicative of an effective tread speed for the apparatus;

a resistive element operably coupled with the at least one treadle, the resistive element including at least one resistance level; and a second sensor in communication with the master control unit a data structure containing data indicative of the amount of energy expended for at least one of a given effective tread speed and a given resistance level;

wherein the at least one treadle has at least one movement;

wherein the second sensor generated at least one second signal with each movement of a treadle; and wherein the master control unit calculates an amount of energy expended based upon the first and second signals, and the master control unit utilizes data from the data structure in calculating the amount of energy expended.

4. The exercise apparatus of claim 1, wherein the at least one treadle has at least a downward movement; and wherein the second sensor generates the at least one second signal with each downward movement of a treadle.

5. An exercise apparatus comprising:

at least one treadle having at least one tread;

a master control unit;

a first sensor, in communication with the master control unit, which generates a first signal indicative of an effective tread speed for the apparatus;

a resistive element operably coupled with the at least one treadle, the resistive element including at least one resistance level; and a second sensor in communication with the master control unit wherein the at least one treadle has at least one movement;

wherein the second sensor generated at least one second signal with each movement of a treadle; and wherein the master control unit determines an amount of calories expended based upon the second signal when the first sensor provides a null reading.

6. The exercise apparatus of claim 5, wherein the apparatus is configured in stepping mode.

7. An exercise apparatus comprising:

at least one treadle having at least one tread;

a master control unit;

a first sensor, in communication with the master control unit, which generates a first signal indicative of an effective tread speed for the apparatus;

a resistive element operably coupled with the at least one treadle, the resistive element including at least one resistance level; and a second sensor in communication with the master control unit wherein the at least one treadle has at least one movement;

wherein the second sensor generated at least one second signal with each movement of a treadle; and wherein the master control unit determines an amount of energy expended based upon the first signal when the second signal provides a null reading.

8. The exercise apparatus of claim 7, wherein the apparatus is configured in treadmill only mode.

* * * * *

UNITED STATES PATENT AND TRADEMARK OFFICE

CERTIFICATE OF CORRECTION

PATENT NO. : 7,618,346 B2
APPLICATION NO. : 10/789579
DATED : November 17, 2009
INVENTOR(S) : Crawford et al.

It is certified that error appears in the above-identified patent and that said Letters Patent is hereby corrected as shown below:

Title page, Item (56), References Cited, U.S. PATENT DOCUMENTS, insert the following:

--5,976,083 A 11/1999 Richardson et al.--

Title page, Item (56), References Cited, FOREIGN PATENT DOCUMENTS, insert the following:

--EP 0 176 277 A2 04/1986--

Title page, Item (56), References Cited, OTHER PUBLICATIONS, insert the following:

--Supplementary European Search Report dated June 26, 2008 for corresponding European Patent Application No. 04 71 5667.4 (6 pages).--

--"Nautilus Home Health & Fitness Catalog", Nautilus, Inc., pages 1-56 (2004).--

Signed and Sealed this
Third Day of May, 2011

David J. Kappos

David J. Kappos
*Director of the United States Patent and Trademark Office*